US009601062B2

(12) United States Patent
An

(10) Patent No.: US 9,601,062 B2
(45) Date of Patent: Mar. 21, 2017

(54) BACKLIGHT DIMMING METHOD AND LIQUID CRYSTAL DISPLAY USING THE SAME

(71) Applicant: LG DISPLAY CO., LTD., Seoul (KR)

(72) Inventor: Jooyoung An, Pyeongtaek-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/878,467

(22) Filed: Oct. 8, 2015

(65) Prior Publication Data

US 2016/0027384 A1 Jan. 28, 2016

Related U.S. Application Data

(62) Division of application No. 13/653,746, filed on Oct. 17, 2012, now Pat. No. 9,189,998.

(30) Foreign Application Priority Data

Feb. 24, 2012 (KR) ..... 10-2012-0019224

(51) Int. Cl.
*G09G 3/34* (2006.01)

(52) U.S. Cl.
CPC ..... *G09G 3/342* (2013.01); *G09G 3/3406* (2013.01); *G09G 3/3413* (2013.01); *G09G 3/3426* (2013.01); *G09G 2320/0646* (2013.01); *G09G 2320/0686* (2013.01); *G09G 2330/021* (2013.01); *G09G 2360/16* (2013.01)

(58) Field of Classification Search
CPC .... G09G 3/342; G09G 3/3426; G09G 3/3406; G09G 3/3413
USPC ..... 345/102
See application file for complete search history.

(56) References Cited

U.S. PATENT DOCUMENTS

2008/0278432 A1 11/2008 Ohshima
2010/0020005 A1 1/2010 Jung et al.
2010/0039440 A1 2/2010 Tanaka et al.
2010/0066752 A1* 3/2010 Watanuki ..... G09G 3/3426 345/102
2010/0085374 A1 4/2010 Lee et al.
(Continued)

FOREIGN PATENT DOCUMENTS

CN 102214446 A 10/2011
CN 102231264 A 11/2011
JP 201122286 A 11/2011

OTHER PUBLICATIONS

Office Action issued in Chinese Patent Application No. 201210465043.8, mailed Dec. 12, 2014, 16 pages.
(Continued)

*Primary Examiner* — Adam J Snyder
(74) *Attorney, Agent, or Firm* — Brinks Gilson & Lione

(57) ABSTRACT

A backlight dimming method and a liquid crystal display using the same are disclosed. The backlight dimming method includes producing a first backlight dimming value controlling a backlight luminance of a liquid crystal display panel, producing a convex gain which has less value in a peripheral part of a screen of the liquid crystal display panel than a central part of the screen, reducing the first backlight dimming value to be applied to the peripheral part of the screen using the convex gain to produce a second backlight dimming value, and controlling the backlight luminance of the liquid crystal display panel using the second backlight dimming value.

6 Claims, 39 Drawing Sheets

(56) References Cited

U.S. PATENT DOCUMENTS

| | | | |
|---|---|---|---|
| 2010/0220048 | A1 | 9/2010 | Yamamura et al. |
| 2011/0141090 | A1 | 6/2011 | Hong et al. |
| 2011/0249039 | A1 | 10/2011 | Ogi et al. |
| 2011/0292018 | A1 | 12/2011 | Kubota et al. |
| 2012/0287172 | A1 | 11/2012 | Lin et al. |

OTHER PUBLICATIONS

Office Action issued in corresponding Korean Patent Application No. 10-2012-0019224, mailed Jun. 20, 2013, 5 pages.

* cited by examiner

BACKLIGHT DIMMING METHOD AND LIQUID CRYSTAL DISPLAY USING THE SAME

The present patent document is a divisional of U.S. patent application Ser. No. 13/653,746, filed Oct. 17, 2012, which claims benefit of Korean Patent Application No. 10-2012-0019224 filed on Feb. 24, 2012, the content of which is incorporated herein by reference in its entirety.

BACKGROUND

Field of the Invention

Embodiments of the disclosure relate to a backlight dimming method and a liquid crystal display using the same.

Discussion of the Related Art

A backlight dimming method has been applied to a liquid crystal display, so as to improve contrast characteristic of the liquid crystal display and to reduce power consumption of the liquid crystal display. The backlight dimming method analyzes an input image and adjusts a backlight luminance based on the result of an analysis of the input image.

Backlight dimming methods include a global dimming method and a local dimming method. The global dimming method uniformly adjusts a luminance of the entire screen of the liquid crystal display based on the result of an analysis of an input image corresponding to one frame. The local dimming method divides the screen of the liquid crystal display into a plurality of blocks and analyzes an input image of each block, thereby adjusting a backlight luminance of each block based on the result of an analysis of the input image of each block. The global dimming method and the local dimming method may modulate pixel data of the input image to thereby compensate for the degradation of image quality, for example, a grayscale saturation and a grayscale band resulting from the backlight dimming method.

The global dimming method may improve a dynamic contrast measured between two successively arranged frames. The local dimming method locally controls a luminance of the screen of each block during one frame period, thereby improving a static contrast which is difficult to improve using the global dimming method.

The related art backlight dimming method including the global dimming method and the local dimming method adjusts the backlight luminance depending on the input image. For example, the related art backlight dimming method increases the backlight luminance in a block, in which the input image is entirely bright or the bright image is displayed. On the other hand, the related art backlight dimming method reduces the backlight luminance in a block, in which the input image is entirely dark or the dark image is displayed. In other words, the related art backlight dimming method increases the backlight luminance when the bright image is input, and thus has a limitation in a reduction in the power consumption.

BRIEF SUMMARY

A backlight dimming method includes producing a first backlight dimming value controlling a backlight luminance of a liquid crystal display panel, producing a convex gain which has less value in a peripheral part of a screen of the liquid crystal display panel than a central part of the screen, reducing the first backlight dimming value to be applied to the peripheral part of the screen using the convex gain to produce a second backlight dimming value, and controlling the backlight luminance of the liquid crystal display panel using the second backlight dimming value.

In another aspect, a liquid crystal display includes a dimming value generator configured to produce a first backlight dimming value controlling a backlight luminance of a liquid crystal display panel, a convex gain calculator configured to produce a convex gain which has less value in a peripheral part of a screen of the liquid crystal display panel than a central part of the screen, and a backlight dimming adjuster configured to reduce the first backlight dimming value to be applied to the peripheral part of the screen using the convex gain, produce a second backlight dimming value, and control the backlight luminance of the liquid crystal display panel using the second backlight dimming value.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE DRAWINGS AND THE PRESENTLY PREFERRED EMBODIMENTS

Figure 1:
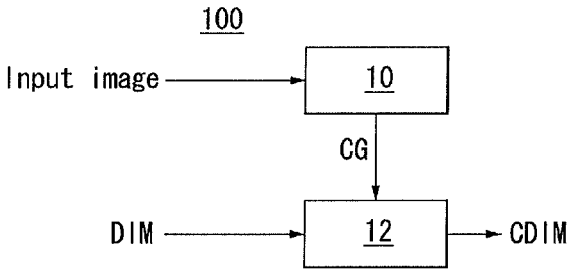
FIG. 1 is a block diagram of a backlight dimming control device according to an example embodiment of the invention.

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

The present inventors repeatedly carried out an experiment, in which they displayed various test images on a liquid crystal display in a darkroom environment and analyzed changes in a luminance perceived with the naked eye while adjusting luminances of a central part and a peripheral part of the screen of the liquid crystal display, on which the test images were displayed. The present inventors confirmed based on the result of the image quality evaluation experiment with the naked eye in the darkroom environment that participants sensitively perceived the luminance change in the central part of the screen of the liquid crystal display, but less sensitively perceived the luminance change in the peripheral part of the screen of the liquid crystal display.

The present inventors adjusted a backlight dimming value for controlling a backlight luminance so as to reduce power consumption. In this instance, the present inventors adjusted, so that a backlight dimming value of the peripheral part of the screen was much less than a backlight dimming value of the central part of the screen in consideration of a recognition characteristic difference of the luminance change between the central part and the peripheral part of the screen. The backlight dimming value is a pulse width modulation (PWM) signal produced based on the result of an analysis of an input image using an existing global or local dimming algorism and determines the backlight luminance, which is varied depending on the input image. In general, a PWM duty of the backlight dimming value increases as a brightness of the input image increases. The backlight luminance is proportional to the PWM duty defined by the backlight dimming value.

If the backlight luminance of the peripheral part of the screen in all of images is uniformly reduced irrespective of the input image, a viewer may recognize changes in a luminance of the peripheral part of the screen when the backlight luminance of the peripheral part of the screen changes. The present inventors proposed a method for reducing an adjustment degree of the backlight luminance applied to the peripheral part of the screen based on the result of the analysis of the input image, so that the viewer cannot recognize the luminance change of the peripheral part of the screen. For example, the present inventors greatly reduced the backlight dimming value applied to the peripheral part of the screen in an image, of which the luminance change is not recognized by the viewer, and slightly reduced the backlight dimming value applied to the peripheral part of the screen in an image, of which the luminance change may be sensitively recognized by the viewer.

The present inventors adjusted the backlight dimming value using a convex gain which has less value in the peripheral part of the screen than the central part of the screen. In this instance, the present inventors virtually divided the screen of the liquid crystal display into a plurality of blocks and adaptively adjusted a value of the convex gain based on the result of the analysis of the input image. The convex gain is calculated based on the result of the analysis of the input image and is a backlight dimming adjustment value for adjusting the backlight dimming value.

As described above, an example embodiment of the invention controls the backlight luminance based on the convex gain. Characteristics of the embodiment of the invention will be made in detail to embodiments of the invention, examples of which are illustrated in the accompanying drawings.

As shown in FIG. 1, a backlight dimming control device 100 according to an example embodiment of the invention includes a convex gain calculator 10 and a backlight dimming adjuster 12.

Figure 2:
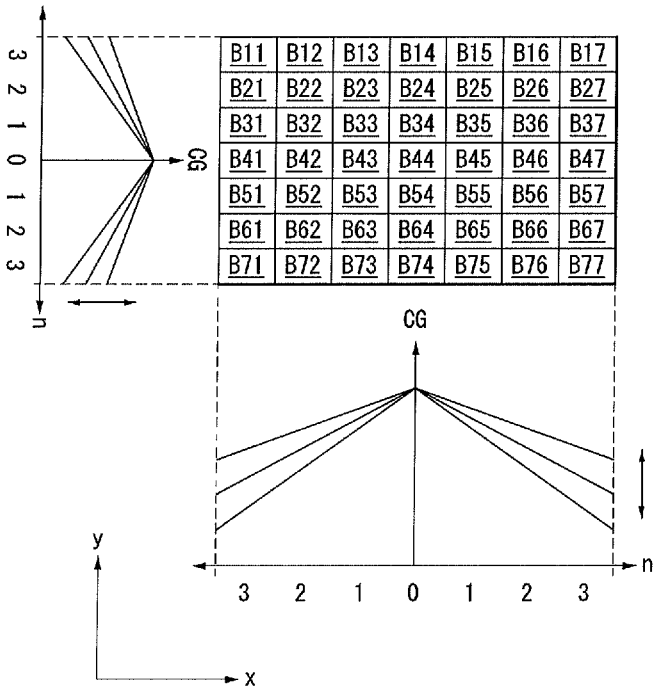
FIG. 2 illustrates an example of a convex gain according to an example embodiment of the invention.

The convex gain calculator 10 multiplies a convex gain CG by a backlight dimming value and adjusts a backlight dimming value applied to an edge of the screen of a liquid crystal display panel to be less than a backlight dimming value applied to the center of the screen of the liquid crystal display panel. The convex gain CG may be a fixed value, which is previously determined, or may be adjusted based on the result of an analysis of an input image as shown in FIG. 2. Although the convex gain CG is set to the fixed value or is varied depending on the input image, the convex gain CG has a value between 0 and 1. Further, the convex gain CG in the edge of the screen is less than the convex gain CG in the center of the screen.

The convex gain calculator 10 receives the input image and may calculate the convex gain CG based on the result of the analysis of the input image. The convex gain calculator 10 analyzes the complexity of the input image. Hence, when the complexity of the input image has a relative large value, the convex gain calculator 10 greatly reduces the convex gain CG to be applied to a peripheral part of the screen of the liquid crystal display panel. On the other hand, when the complexity of the input image has a relative small value, the convex gain calculator 10 slightly reduces the convex gain CG to be applied to the peripheral part of the screen. According to the result of the above-described experiment, as the complexity of an image displayed on the liquid crystal display panel increases, the participants less sensitively perceived changes in a luminance of the display image. The complexity of the input image may be calculated by the number of edges (corresponding to a boundary) of the liquid crystal display panel or the number of recognizable colors. Other factors may be used for the complexity.

The convex gain calculator 10 calculates the convex gain CG based on the result of an analysis of the complexity of the input image and analyzes luminance characteristic of the input image, thereby adjusting the convex gain CG in consideration of the complexity and the luminance characteristic of the input image. This is derived based on the result of the above-described experiment, because a recognition degree of the luminance change of the display image, which the participants perceive, varies depending on the luminance characteristic of the image displayed on the liquid crystal display panel. The convex gain CG is reduced in proportion to parameters $\alpha 1$ to $\alpha 4$ and $\alpha$, which are produced based on the result of the analysis of the input image, as indicated by the following Equation (1).

The backlight dimming adjuster 12 receives a backlight dimming value DIM and multiplies the backlight dimming value DIM by the convex gain CG to output a backlight dimming value CDIM compensated by the convex gain CG. The backlight dimming value DIM is a digital signal calculated by the existing global/local dimming algorism and includes PWM duty information determining a backlight luminance of a liquid crystal display. The backlight dimming value DIM is produced from a dimming value generator implemented by a local dimming circuit 14 shown in FIG. 25 or a host system. The compensated backlight dimming value CDIM output from the backlight dimming adjuster 12 is input to a light source driver 310 shown in FIG. 25 and controls the backlight luminance of the liquid crystal display. In the claims, the backlight dimming value DIM input to the backlight dimming adjuster 12 is defined by a first backlight dimming value, and the compensated backlight dimming value CDIM output from the backlight dimming adjuster 12 is defined by a second backlight dimming value.

As shown in FIG. 2, in the liquid crystal display according to the embodiment of the invention, a pixel array and a backlight light emitting surface of the screen, on which the input image is displayed, are virtually divided into a plurality of blocks B11 to B77. In FIG. 2, 'n' is a block identification number indicating a block position. A block of block identification number '0' is a block existing in the center of the screen. As the block identification number increases, it corresponds to blocks (i.e., peripheral blocks of the screen) far from the center of the screen. The convex gain CG is determined based on the result of the analysis of the input image and has a value between 0 and 1. The convex gain CG has a maximum value in the center block B44 positioned in the center of the screen. As the blocks are far from the center of the screen, the convex gain CG decreases. Namely, the convex gain CG has a minimum value in the outermost blocks (i.e., the peripheral blocks) B11 to B17, B21, B31, B41, B51, B61, B27, B37, B47, B57, B67, and B71 to B77 of the screen. A method for dividing the screen is not limited to FIG. 2. For example, the screen of the liquid crystal display panel may be virtually divided into N×M blocks. In the N×M blocks, each of N and M may be equal to or greater than 3, and one of N and M may be equal to or less than 2 and the other may be equal to or greater than 3. For example, the screen of the liquid crystal display panel may be divided into three or more blocks in each of a horizontal direction x and a vertical direction y, for example, 5×5 and 10×10. Alternatively, the screen of the liquid crystal display panel may be divided into three or more blocks only in one of the horizontal direction x and the vertical direction y, for example, 5×1, 10×1, 1×5, and 1×10.

Figure 3:
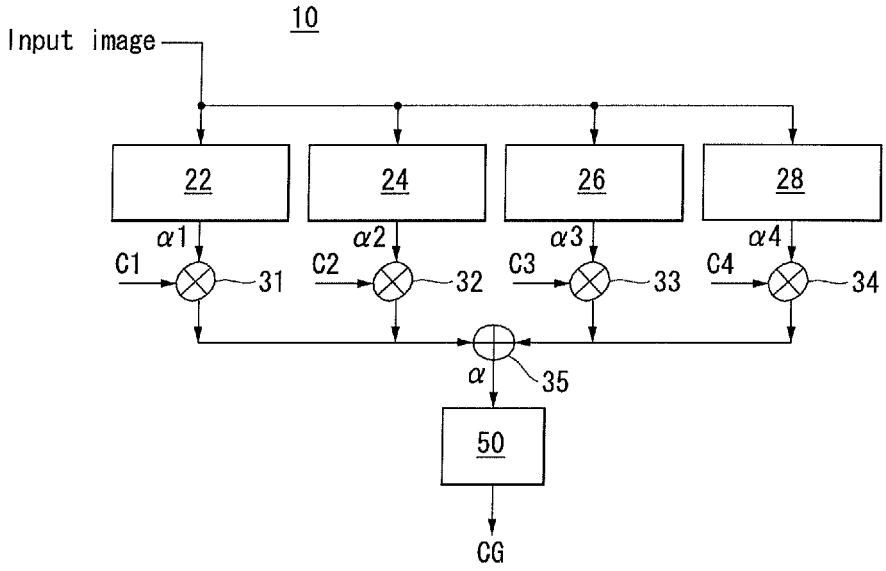
FIG. 3 is a block diagram of a convex gain calculator according to a first embodiment of the invention.
Figure 4:
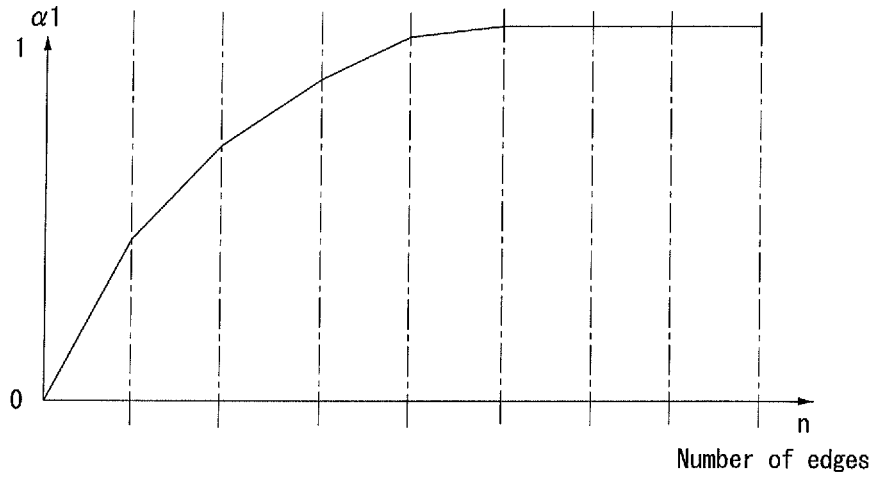
FIG. 4 illustrates an example of a mapping curve showing a first parameter selected by a first image analyzer shown in FIG. 3.
Figure 5:
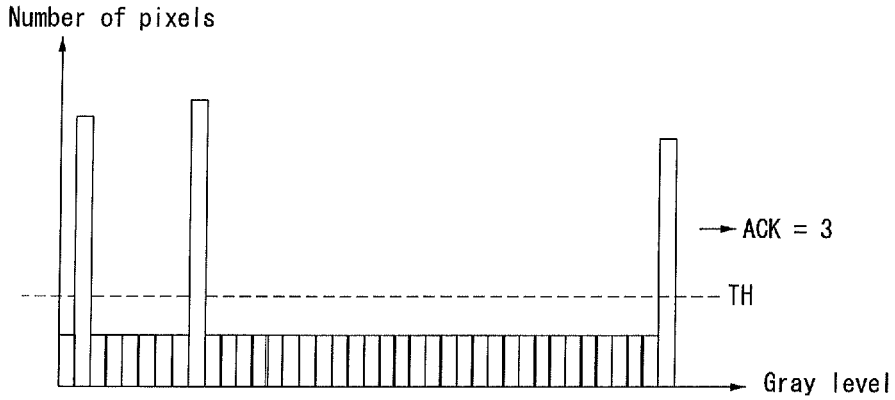
FIG. 5 illustrates an example of a histogram of an input image.
Figure 6:
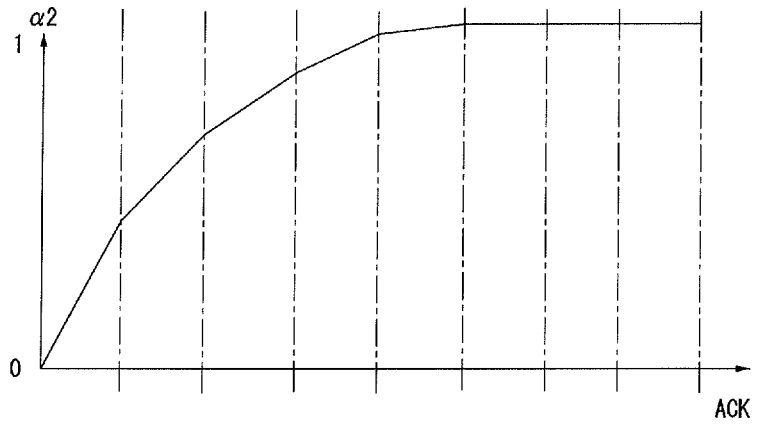
FIG. 6 illustrates an example of a mapping curve showing a second parameter selected by a second image analyzer shown in FIG. 3.
Figure 7:
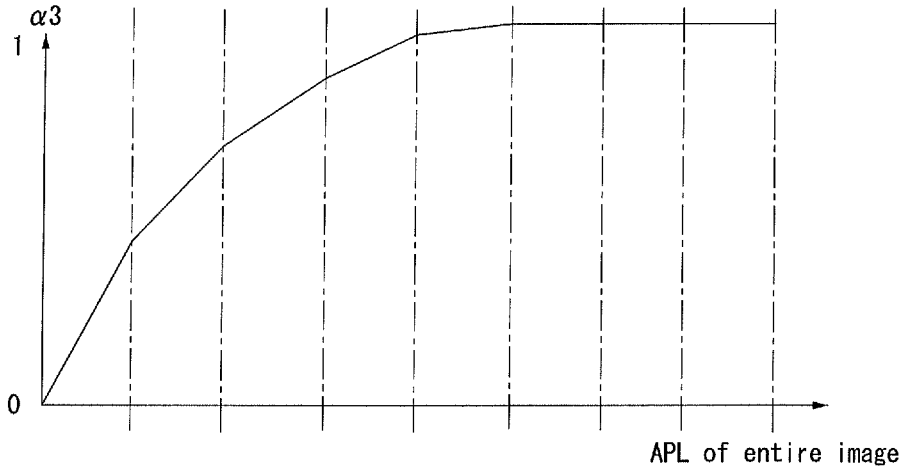
FIG. 7 illustrates an example of a mapping curve showing a third parameter selected by a third image analyzer shown in FIG. 3.
Figure 8:
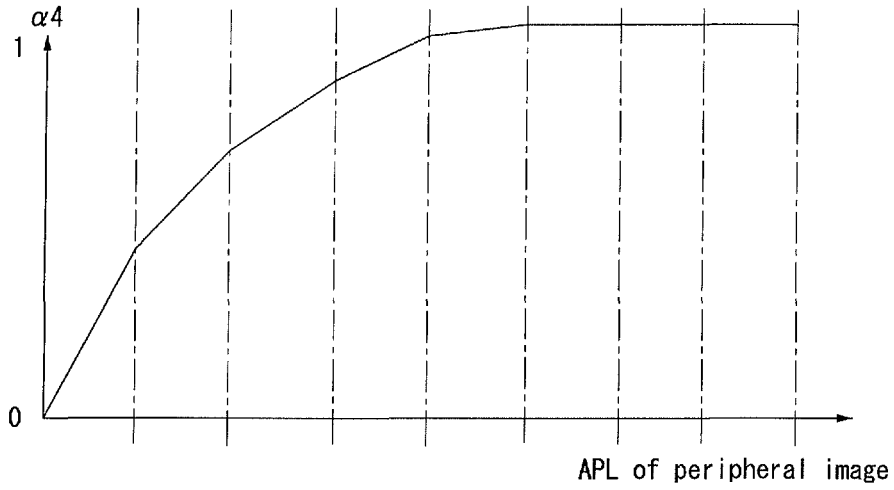
FIG. 8 illustrates an example of a mapping curve showing a fourth parameter selected by a fourth image analyzer shown in FIG. 3.

FIG. 3 is a block diagram showing in detail the convex gain calculator 10. FIG. 4 illustrates an example of a mapping curve showing a first parameter selected by a first image analyzer shown in FIG. 3. FIG. 5 illustrates an example of a histogram of an input image. FIG. 6 illustrates an example of a mapping curve showing a second parameter selected by a second image analyzer shown in FIG. 3. FIG. 7 illustrates an example of a mapping curve showing a third parameter selected by a third image analyzer shown in FIG. 3. FIG. 8 illustrates an example of a mapping curve showing a fourth parameter selected by a fourth image analyzer shown in FIG. 3.

As shown in FIGS. 3 to 8, the convex gain calculator 10 includes image analyzers 22, 24, 26, and 28, multipliers 31 to 34, an adder 35, an operation logic unit 50, etc.

The image analyzers 22, 24, 26, and 28 include at least one of first to fourth image analyzers 22, 24, 26, and 28. The multipliers 31 to 34 include at least one of first to fourth multipliers 31 to 34.

If luminance distribution or color of the image displayed on the screen of the liquid crystal display panel is simple, a viewer may sensitively perceive changes in a luminance of the display image. On the other hand, the viewer may be insensitive to changes in a luminance of the display image having the large complexity. The complexity of the display image increases in proportion to the number of edges, which the viewer can recognize in the display image, and the number of recognizable colors. The viewer may recognize the edge of the display image as a suddenly changing straight line or a suddenly changing curve line, etc in the luminance or the color. The first and second image analyzers 22 and 24 decide the complexity of the input image.

The first image analyzer 22 receives the input image and extracts block image data to be displayed on the peripheral blocks of the screen from data of the input image, thereby analyzing image data on a per block basis. The first image analyzer 22 inputs the block image data to be displayed on the peripheral blocks of the screen to a known edge detection mask filter and detects edges equal to or greater than a predetermined length. The edge detection mask filter multiplies a previously determined coefficient by the image data to be displayed on the peripheral part of the screen to detect the edges. The first image analyzer 22 compares the edges detected by the edge detection mask filter with a predetermined threshold value. Hence, the edges, which is equal to or greater than the threshold value, are set to '1', and the edges, which is less than the threshold value, are set to '0', thereby binarizing the edge distribution in a peripheral image of the screen. The first image analyzer 22 adds a binarization result of the edge distribution to decide the number of edges the viewer can recognize. As shown in FIG. 4, the first image analyzer 22 maps the number of edges to a previously determined mapping curve to select a first parameter $\alpha 1$. The mapping curve of FIG. 4 defines a first parameter $\alpha 1$, which increases in proportion to the number of edges and has a value between 0 and 1. The mapping curve of FIG. 4 is stored in a lookup table ROM and may be adjusted by a user. In the embodiment of the invention, the user may be a maker making electric home appliances or an information terminal using a display device, for example, a television set, a navigator, a personal digital assistant, etc.

The convex gain CG to be applied to the peripheral part of the screen decreases as the first parameter $\alpha 1$, which increases in proportion to the complexity of the input image, increases. Thus, the convex gain CG to be applied to the peripheral part of the screen decreases as the complexity of the input image increases. Hence, the convex gain CG reduces a backlight dimming value to be applied to the peripheral blocks of the screen.

The first multiplier 31 multiplies the first parameter $\alpha 1$ received from the first image analyzer 22 by a first weighting value C1. The first weighting value C1 has a value between 0 and 1. In this instance, the first weighting value C1 is selected to a value capable of satisfying a condition (i.e., C1+C2+C3+C4=1) that a sum of first to fourth weighting values C1 to C4 is 1. The first weighting value C1 may be adjusted by the user.

The second image analyzer 24 receives the input image and analyzes image data, each of which corresponds to one frame on a per frame basis, including pixel data to be written to the pixels of the entire screen. The second image analyzer 24 stores input image data in a frame memory and calculates a histogram of image data corresponding to one frame read from the frame memory, thereby calculating the number of pixels at each gray level. In the embodiment of the invention, the number of pixels means pixel data of the input image, which is input in the form of digital video data. The histogram of each of red, green, and blue is calculated. The second image analyzer 24 decides gray levels, at which the number of pixels is equal to or greater than a threshold value TH of FIG. 5, based on the histogram and calculates a sum of the gray levels. The frame memory may be omitted in the calculation of the histogram. For example, if the number of input pixel data is accumulated in real time in the calculation of the histogram and is stored in a histogram memory with a small capacity, a histogram analysis circuit may be implemented without the frame memory.

In FIG. 5, the threshold value TH is the minimum number of pixels capable of representing the colors which the viewer can recognize with the naked eye. Thus, in FIG. 5, 'ACK' is the number of recognizable colors. As shown in FIG. 6, the second image analyzer 24 maps the number ACK of recognizable colors to a previously determined mapping curve to select a second parameter $\alpha 2$. The mapping curve of FIG. 6 defines the second parameter $\alpha 2$, which increases in proportion to the number ACK of recognizable colors and has a value between 0 and 1. The mapping curve of FIG. 6 is stored in the lookup table ROM and may be adjusted by the user.

The convex gain CG to be applied to the peripheral part of the screen decreases as the second parameter α2, which increases in proportion to the complexity of the input image, increases. Thus, the convex gain CG to be applied to the peripheral part of the screen decreases as the complexity of the input image increases. Hence, the convex gain CG reduces the backlight dimming value to be applied to the peripheral blocks of the screen.

The second multiplier 32 multiplies the second parameter a2 received from the second image analyzer 24 by a second weighting value C2. The second weighting value C2 has a value between 0 and 1. In this instance, the second weighting value C2 is selected to a value capable of satisfying a condition (i.e., C1+C2+C3+C4=1) that a sum of first to fourth weighting values C1 to C4 is 1. The second weighting value C2 may be adjusted by the user.

In general, the existing global dimming algorism increases the backlight luminance as the brightness of the entire image of one screen corresponding to one frame increases. The existing local dimming algorism analyzes the input image on a per block basis and increases a backlight luminance of a block, on which a bright image is displayed. Thus, the existing global and local dimming algorisms have a limitation in a reduction in the power consumption. On the other hand, the embodiment of the invention adjusts the convex gain CG based on third and fourth parameters α3 and α4 selected from the third and fourth image analyzers 26 and 28. Hence, the embodiment of the invention reduces the convex gain CG in proportion to an average brightness of the image within range, in which the viewer hardly recognizes the luminance change, and thus may reduce the power consumption even in the bright image.

The third image analyzer 26 receives the input image and analyzes the luminance characteristic of the input image on a per frame basis. For this, the third image analyzer 26 stores input image data in the frame memory and calculates an average value or an average picture level (APL) of image data corresponding to one frame read from the frame memory. In the embodiment of the invention, the average value is an average value obtained by dividing R, G, and B maximum values of R, G, and B values of each pixel by the number of pixels, and the average picture level is an average value obtained by dividing a sum of luminances Y of the pixels by the number of pixels.

As shown in FIG. 7, the third image analyzer 26 maps the average value or the average picture level of the entire image corresponding to one frame to a previously determined mapping curve to select a third parameter α3. The mapping curve of FIG. 7 defines the third parameter α3, which increases in proportion to the average value or the average picture level of the entire image corresponding to one frame and has a value between 0 and 1. The mapping curve of FIG. 7 is stored in the lookup table ROM and may be adjusted by the user.

The convex gain CG to be applied to the peripheral part of the screen decreases as the third parameter α3 increases. Thus, the convex gain CG to be applied to the peripheral part of the screen reduces the backlight dimming value irradiated onto the peripheral part of the screen in proportion to an average brightness of the entire image corresponding to one frame.

The third multiplier 33 multiplies the third parameter α3 received from the third image analyzer 26 by a third weighting value C3. The third weighting value C3 has a value between 0 and 1. In this instance, the third weighting value C3 is selected to a value capable of satisfying a condition (i.e., C1+C2+C3+C4=1) that a sum of first to fourth weighting values C1 to C4 is 1. The third weighting value C3 may be adjusted by the user.

The fourth image analyzer 28 receives the input image and analyzes the luminance characteristic of the input image on a per block basis. For this, the fourth image analyzer 28 stores input image data in the frame memory and extracts data to be displayed on the peripheral blocks from the image data read from the frame memory. The fourth image analyzer 28 calculates an average value or an average picture level (APL) of the extracted peripheral image data.

As shown in FIG. 8, the fourth image analyzer 28 maps the average value or the average picture level of the peripheral image data to be displayed on the peripheral blocks to a previously determined mapping curve to select a fourth parameter α4. The mapping curve of FIG. 8 defines the fourth parameter α4, which increases in proportion to the average value or the average picture level of the peripheral image and has a value between 0 and 1. The mapping curve of FIG. 8 is stored in the lookup table ROM and may be adjusted by the user.

The convex gain CG to be applied to the peripheral part of the screen decreases as the fourth parameter α4 increases. Thus, the convex gain CG to be applied to the peripheral part of the screen reduces the backlight dimming value irradiated onto the peripheral part of the screen in proportion to an average brightness of the peripheral image to be displayed on the peripheral blocks.

The fourth multiplier 34 multiplies the fourth parameter α4 received from the fourth image analyzer 28 by a fourth weighting value C4. The fourth weighting value C4 has a value between 0 and 1. In this instance, the fourth weighting value C4 is selected to a value capable of satisfying a condition (i.e., C1+C2+C3+C4=1) that a sum of the first to fourth weighting values C1 to C4 is 1. The fourth weighting value C4 may be adjusted by the user.

The adder 35 adds the outputs of the first to fourth multipliers 31 to 34 to one another and supplies an addition result α to the operation logic unit 50. The operation logic unit 50 substitutes a sum α of the parameters, to which the weighting values are applied, for the following Equation (1) and calculates the convex gain CG using a value obtained by dividing a substitution result by 100.

$$CG = \frac{100 - (n \times \alpha)}{100} \qquad \text{Equation (1)}$$

In the above Equation (1), 'n' is a block identification number, and 'α' is a sum of the parameters, to which the weighting values are applied.

As shown in FIG. 2, 'n' of B44 is 0; 'n' of B43 and B45 is 1; 'n' of B42 and B46 is 2; and 'n' of B41 and B47 is 3. In this instance, the convex gain CG applied to the center block B44 is 1. Further, the convex gain CG of the blocks B43 and B45 is {100−α}/100; the convex gain CG of the blocks B42 and B46 is {100−2α}/100; and the convex gain CG of the blocks B41 and B47 is {100−3α}/100. The outputs α1 to α4 of the image analyzers 22, 24, 26, and 28 may be adjusted by the user, so that the convex gain CG does not have a negative value. Thus, the convex gain CG has a maximum value in the center block of the screen, and has a minimum value in the outermost block of the screen because it has a decreasing value as it goes to the peripheral part of the screen.

When the complexity of the image increases, the viewer hardly perceives the luminance change with the naked eye even if the backlight luminance is reduced in the peripheral part of the screen. On the other hand, when the average brightness of the image is high, the viewer may perceive the luminance change with the naked eye when the backlight luminance is reduced in the peripheral part of the screen. Thus, the convex gain CG is first determined depending on the complexity of the image. Further, it is preferable, but not required, that the convex gain CG is hardly affected by the luminance characteristic of the image. Considering this, in the embodiment of the invention, the weighting values C1 to C4 are set to different values. In this instance, the weighting values C1 and C2 may be set to the large values, and the weighting values C3 and C4 may be set to the small values. The complexity of the image is more affected by the number of edges than the number of recognizable colors. It is preferable, but not required, that the weighting value C1 is set to be greater than the weighting value C2. Further, it is preferable, but not required, that a difference between the weighting values C2 and C3 is set to be greater than a difference between the weighting values C1 and C2, and a difference between the weighting values C2 and C4 is set to be greater than a difference between the weighting values C1 and C2. Hence, a reduction in the image quality may be prevented or reduced. As a result, the weighting values C1 to C4 may have the following relationship: C1>C2>>C3 (or C4). The weighting values C3 and C4 may be substantially equal to each other or may be set to different values having a small difference therebetween.

FIGS. 9A to 23 illustrate various modifications based on the convex gain calculator shown in FIG. 3.

Figure 9A:
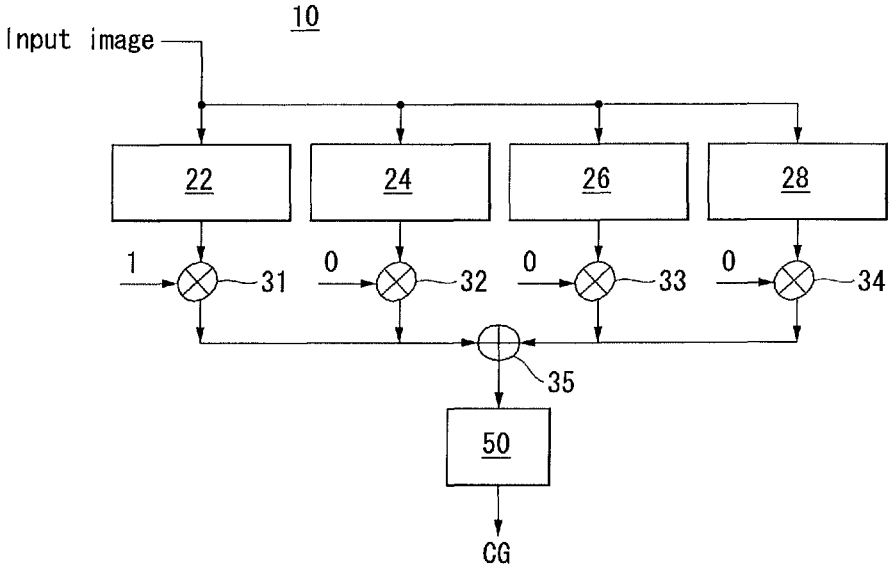
FIGS. 9A to 23 illustrate various modifications based on a convex gain calculator shown in FIG. 3.
Figure 9B:
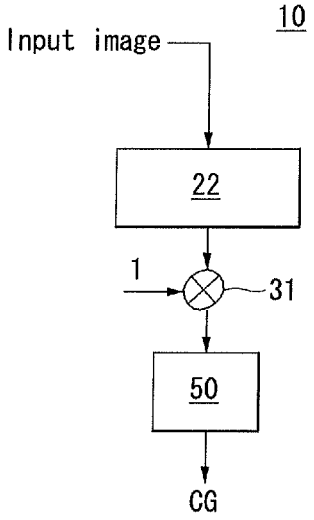

As shown in FIGS. 9A and 9B, the convex gain calculator 10 sets the second to fourth weighting values C2 to C4 to '0' and may calculate the convex gain CG based on the complexity of the image analyzed by the first image analyzer 22. In this instance, the first weighting value C1 is set to a maximum value '1'. Some components 24, 26, 28, 32 to 34, and 35 may be removed in a circuit configuration shown in FIG. 9A. Even if the above components 24, 26, 28, 32 to 34, and 35 are removed, the circuit shown in FIG. 9A may operate in the same manner as the original circuit including the above components 24, 26, 28, 32 to 34, and 35. Hence, the manufacturing cost may be reduced through the simple circuit configuration. As shown in FIG. 9B, because the output of the first image analyzer 22 may be directly supplied to the operation logic unit 50, the first multiplier 31 may be omitted. In FIGS. 9A and 9B, the first image analyzer 22 detects the edge components from the input image, decides the number of edges the viewer can recognize, and maps the number of edges to the mapping curve shown in FIG. 4 to select the first parameter $\alpha 1$. The operation logic unit 50 substitutes the first parameter $\alpha 1$ received from the first image analyzer 22 for '$\alpha$' of the above Equation (1) and calculates the convex gain CG using a value obtained by dividing a substitution result by 100.

Figure 10A:
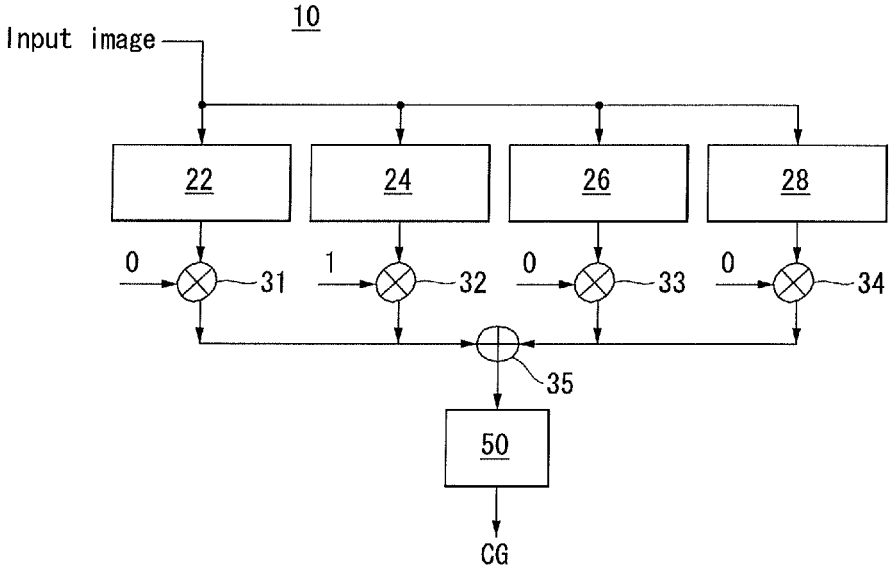
Figure 10B:
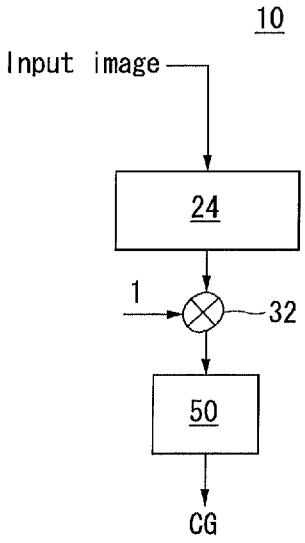

As shown in FIGS. 10A and 10B, the convex gain calculator 10 sets the first, third, and fourth weighting values C1, C3, and C4 to '0' and may calculate the convex gain CG based on the complexity of the image analyzed by the second image analyzer 24. In this instance, the second weighting value C2 is set to a maximum value '1'. Some components 22, 26, 28, 31, 33, 34, and 35 may be removed in a circuit configuration shown in FIG. 10A. Even if the above components 22, 26, 28, 31, 33, 34, and 35 are removed, the circuit shown in FIG. 10A may operate in the same manner as the original circuit including the above components 22, 26, 28, 31, 33, 34, and 35. Hence, the manufacturing cost may be reduced through the simple circuit configuration. As shown in FIG. 10B, because the output of the second image analyzer 24 may be directly supplied to the operation logic unit 50, the second multiplier 32 may be omitted. In FIGS. 10A and 10B, the second image analyzer 24 calculates the number of recognizable colors based on the histogram of the input image and maps the number of recognizable colors to the mapping curve shown in FIG. 6 to select the second parameter $\alpha 2$. The operation logic unit 50 substitutes the second parameter $\alpha 2$ received from the second image analyzer 24 for '$\alpha$' of the above Equation (1) and calculates the convex gain CG using a value obtained by dividing a substitution result by 100.

Figure 11A:
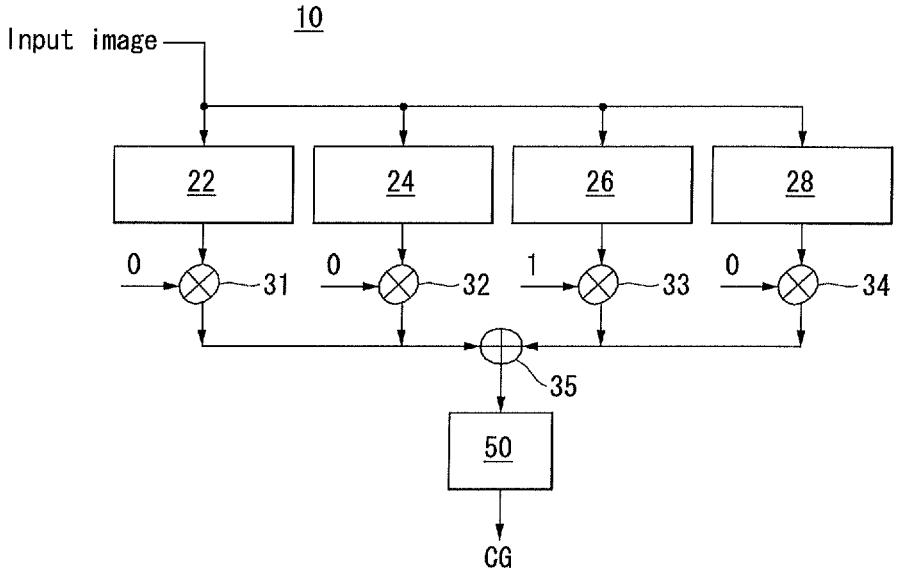
Figure 11B:
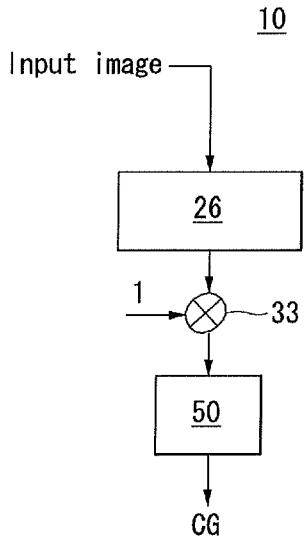

As shown in FIGS. 11A and 11B, the convex gain calculator 10 sets the first, second, and fourth weighting values C1, C2, and C4 to '0' and may calculate the convex gain CG based on the luminance characteristic of the image analyzed by the third image analyzer 26. In this instance, the third weighting value C3 is set to a maximum value '1'. Some components 22, 24, 28, 31, 32, 34, and 35 may be removed in a circuit configuration shown in FIG. 11A. Even if the above components 22, 24, 28, 31, 32, 34, and 35 are removed, the circuit shown in FIG. 11A may operate in the same manner as the original circuit including the above components 22, 24, 28, 31, 32, 34, and 35. Hence, the manufacturing cost may be reduced through the simple circuit configuration. As shown in FIG. 11B, because the output of the third image analyzer 26 may be directly supplied to the operation logic unit 50, the third multiplier 33 may be omitted. In FIGS. 11A and 11B, the third image analyzer 26 calculates an average value or an average picture level (APL) of image data corresponding to one frame and maps the average value or the average picture level of the entire image of one frame to the mapping curve shown in FIG. 7 to select the third parameter $\alpha 3$. The operation logic unit 50 substitutes the third parameter $\alpha 3$ received from the third image analyzer 26 for '$\alpha$' of the above Equation (1) and calculates the convex gain CG using a value obtained by dividing a substitution result by 100.

Figure 12A:
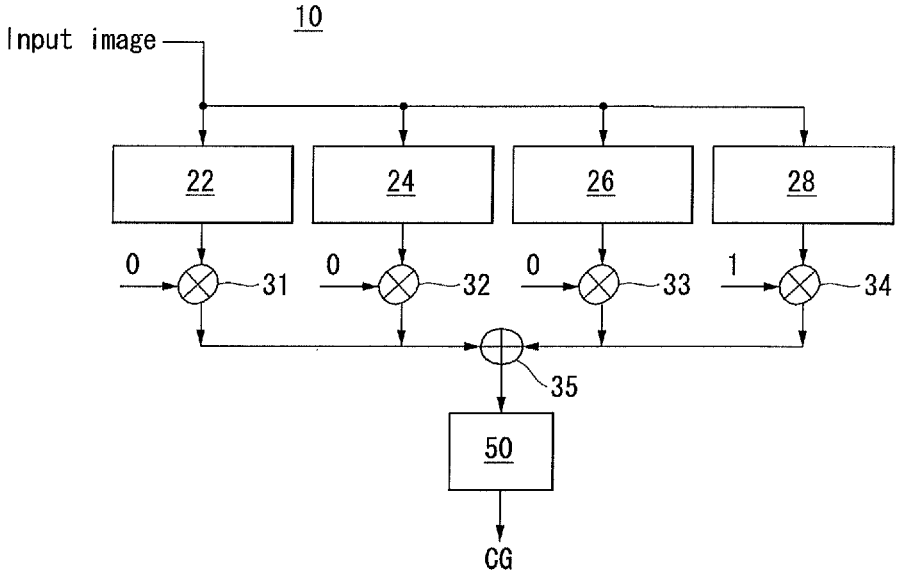
Figure 12B:
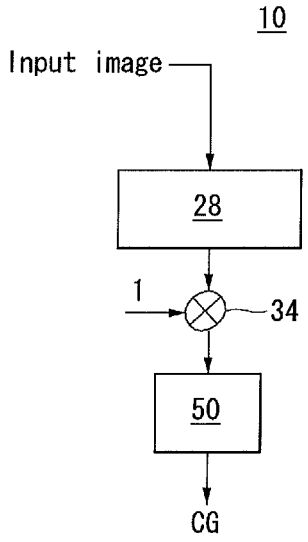

As shown in FIGS. 12A and 12B, the convex gain calculator 10 sets the first to third weighting values C1 to C3 to '0' and may calculate the convex gain CG based on the luminance characteristic of the image analyzed by the fourth image analyzer 28. In this instance, the fourth weighting value C4 is set to a maximum value '1'. Some components 22, 24, 26, 31 to 33, and 35 may be removed in a circuit configuration shown in FIG. 12A. Even if the above components 22, 24, 26, 31 to 33, and 35 are removed, the circuit shown in FIG. 12A may operate in the same manner as the original circuit including the above components 22, 24, 26, 31 to 33, and 35. Hence, the manufacturing cost may be reduced through the simple circuit configuration. As shown in FIG. 12B, because the output of the fourth image analyzer 28 may be directly supplied to the operation logic unit 50, the fourth multiplier 34 may be omitted. In FIGS. 12A and 12B, the fourth image analyzer 28 calculates an average value or an average picture level (APL) of peripheral image data of input image data to be displayed on the peripheral blocks and maps the average value or the average picture level of the peripheral image to the mapping curve shown in FIG. 8 to select the fourth parameter $\alpha 4$. The operation logic unit 50 substitutes the fourth parameter $\alpha 4$ received from the fourth image analyzer 28 for '$\alpha$' of the above Equation (1)

and calculates the convex gain CG using a value obtained by dividing a substitution result by 100.

Figure 13A:
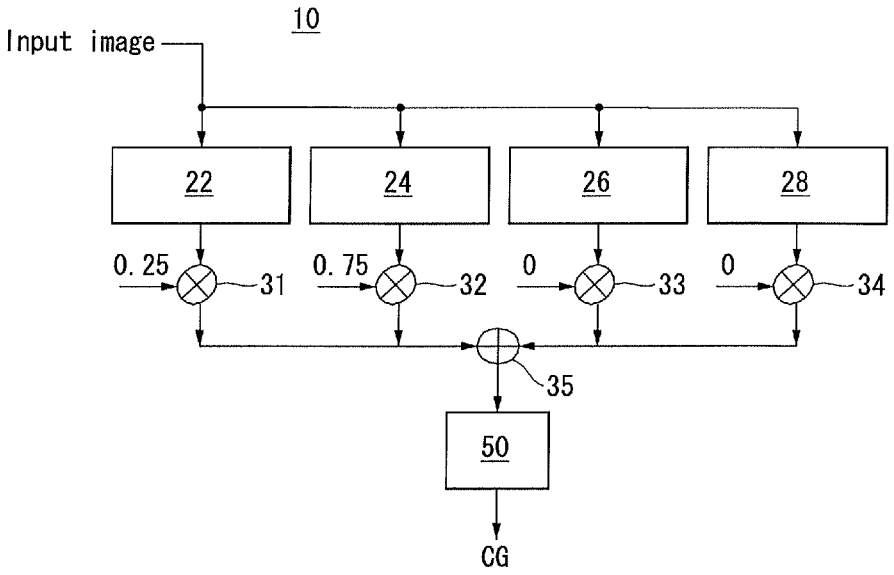
Figure 13B:
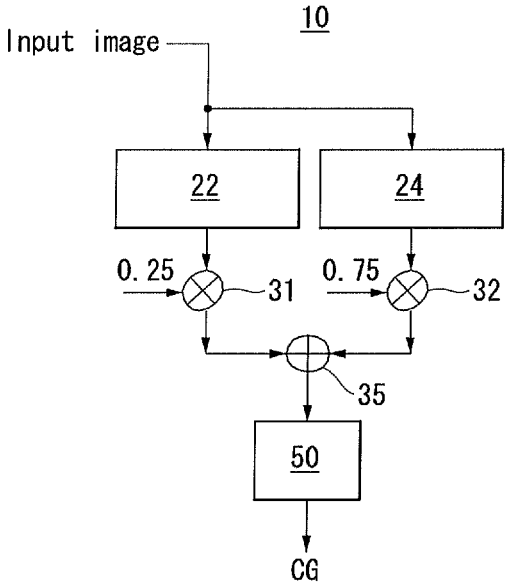

As shown in FIGS. 13A and 13B, the convex gain calculator 10 sets the third and fourth weighting values C3 and C4 to '0' and may calculate the convex gain CG based on the complexity of the image analyzed by the first and second image analyzers 22 and 24. In this instance, a sum of the first and second weighting values C1 and C2 is set to 1, and the first and second weighting values C1 and C2 may be adjusted by the user. For example, as shown in FIG. 13A, C1 and C2 may be respectively set to 0.25 and 0.75. Other values may be used. Some components 26, 28, 33 and 34 may be removed in a circuit configuration shown in FIG. 13A. Even if the above components 26, 28, 33 and 34 are removed, the circuit shown in FIG. 13A may operate in the same manner as the original circuit including the above components 26, 28, 33 and 34. Hence, the manufacturing cost may be reduced through the simple circuit configuration. In FIGS. 13A and 13B, the first image analyzer 22 detects the edge components from the input image, decides the number of edges the viewer can recognize, and maps the number of edges to the mapping curve shown in FIG. 4 to select the first parameter $\alpha 1$. The second image analyzer 24 calculates the number of recognizable colors based on the histogram of the input image and maps the number of recognizable colors to the mapping curve shown in FIG. 6 to select the second parameter $\alpha 2$. The first multiplier 31 multiplies the first parameter $\alpha 1$ by the first weighting value C1 and supplies the multiplication result to the adder 35, and the second multiplier 32 multiplies the second parameter a2 by the second weighting value C2 and supplies the multiplication result to the adder 35. The operation logic unit 50 substitutes the parameter $\alpha$ received from the adder 35 for the above Equation (1) and calculates the convex gain CG using a value obtained by dividing a substitution result by 100.

Figure 14A:
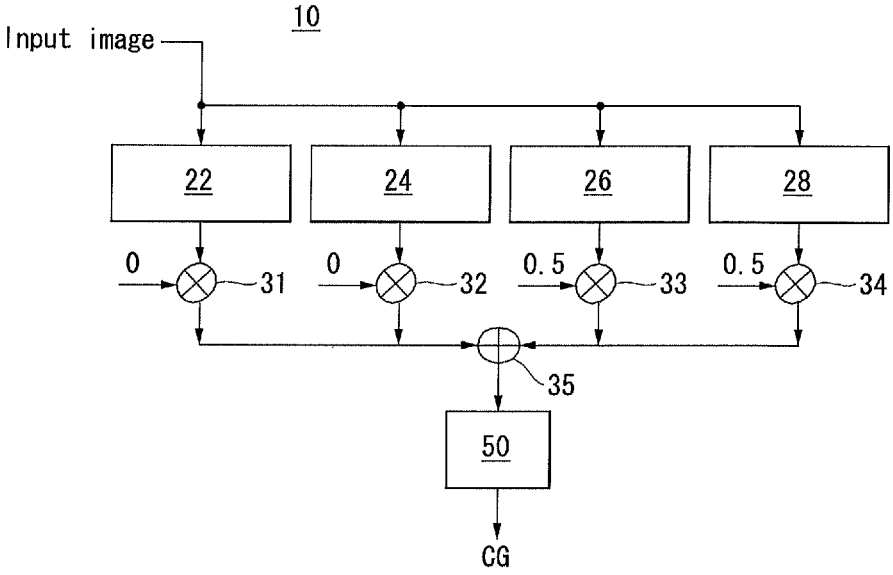
Figure 14B:
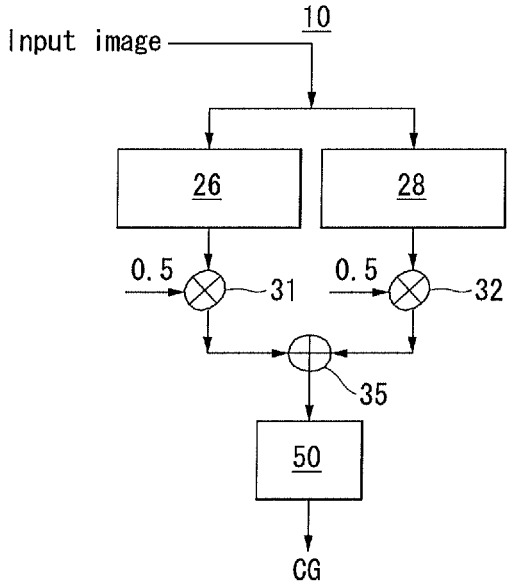

As shown in FIGS. 14A and 14B, the convex gain calculator 10 sets the first and second weighting values C1 and C2 to '0' and may calculate the convex gain CG based on the luminance characteristic of the image analyzed by the third and fourth image analyzers 26 and 28. In this instance, a sum of the third and fourth weighting values C3 and C4 is set to 1, and the third and fourth weighting values C3 and C4 may be adjusted by the user. For example, as shown in FIG. 14A, C3 and C4 may be respectively set to 0.5 and 0.5. Other values may be used. Some components 22, 24, 31 and 32 may be removed in a circuit configuration shown in FIG. 14A. Even if the above components 22, 24, 31 and 32 are removed, the circuit shown in FIG. 14A may operate in the same manner as the original circuit including the above components 22, 24, 31 and 32. Hence, the manufacturing cost may be reduced through the simple circuit configuration. In FIGS. 14A and 14B, the third image analyzer 26 calculates an average value or an average picture level (APL) of image data corresponding to one frame and maps the average value or the average picture level of the entire image of one frame to the mapping curve shown in FIG. 7 to select the third parameter $\alpha 3$. The fourth image analyzer 28 calculates an average value or an average picture level (APL) of peripheral image data of input image data to be displayed on the peripheral blocks and maps the average value or the average picture level of the peripheral image to the mapping curve shown in FIG. 8 to select the fourth parameter $\alpha 4$. The third multiplier 33 multiplies the third parameter $\alpha 3$ by the third weighting value C3 and supplies the multiplication result to the adder 35, and the fourth multiplier 34 multiplies the fourth parameter $\alpha 4$ by the fourth weighting value C4 and supplies the multiplication result to the adder 35. The operation logic unit 50 substitutes the parameter $\alpha$ received from the adder 35 for the above Equation (1) and calculates the convex gain CG using a value obtained by dividing a substitution result by 100.

Figure 15A:
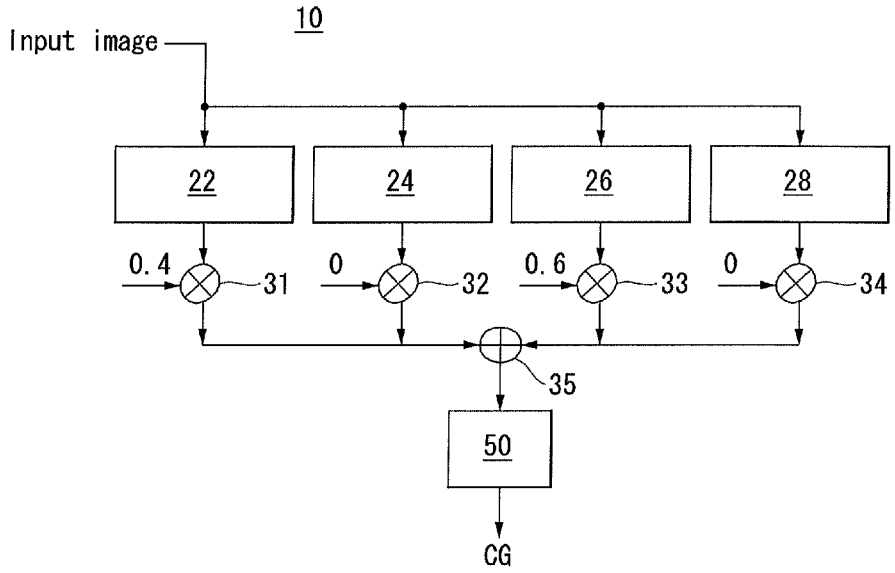
Figure 15B:
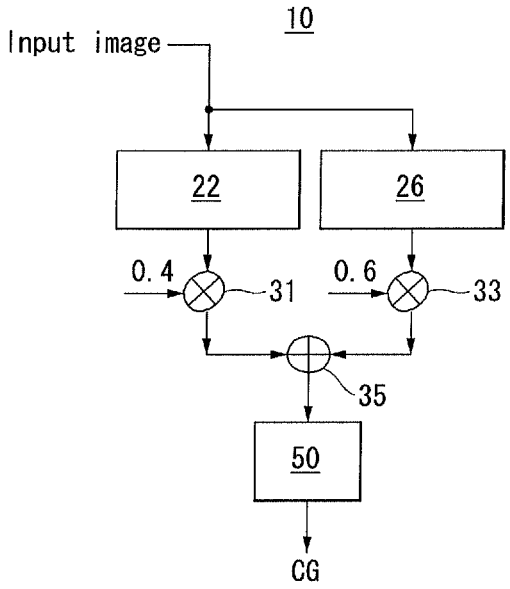

As shown in FIGS. 15A and 15B, the convex gain calculator 10 sets the second and fourth weighting values C2 and C4 to '0' and may calculate the convex gain CG based on the complexity and the luminance characteristic of the image analyzed by the first and third image analyzers 22 and 26. In this instance, a sum of the first and third weighting values C1 and C3 is set to 1, and the first and third weighting values C1 and C3 may be adjusted by the user. For example, as shown in FIG. 15A, C1 and C3 may be respectively set to 0.4 and 0.6. Other values may be used. Some components 24, 28, 32 and 34 may be removed in a circuit configuration shown in FIG. 15A. Even if the above components 24, 28, 32 and 34 are removed, the circuit shown in FIG. 15A may operate in the same manner as the original circuit including the above components 24, 28, 32 and 34. Hence, the manufacturing cost may be reduced through the simple circuit configuration. In FIGS. 15A and 15B, the first image analyzer 22 detects the edge components from the input image, decides the number of edges the viewer can recognize, and maps the number of edges to the mapping curve shown in FIG. 4 to select the first parameter $\alpha 1$. The third image analyzer 26 calculates an average value or an average picture level (APL) of image data corresponding to one frame and maps the average value or the average picture level of the entire image of one frame to the mapping curve shown in FIG. 7 to select the third parameter $\alpha 3$. The first multiplier 31 multiplies the first parameter $\alpha 1$ by the first weighting value C1 and supplies the multiplication result to the adder 35, and the third multiplier 33 multiplies the third parameter $\alpha 3$ by the third weighting value C3 and supplies the multiplication result to the adder 35. The operation logic unit 50 substitutes the parameter $\alpha$ received from the adder 35 for the above Equation (1) and calculates the convex gain CG using a value obtained by dividing a substitution result by 100.

Figure 16A:
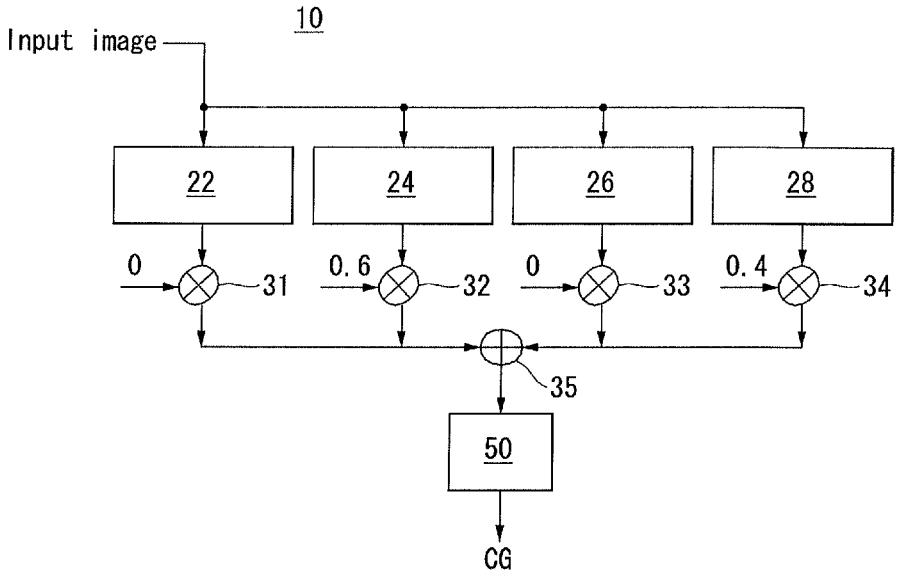
Figure 16B:
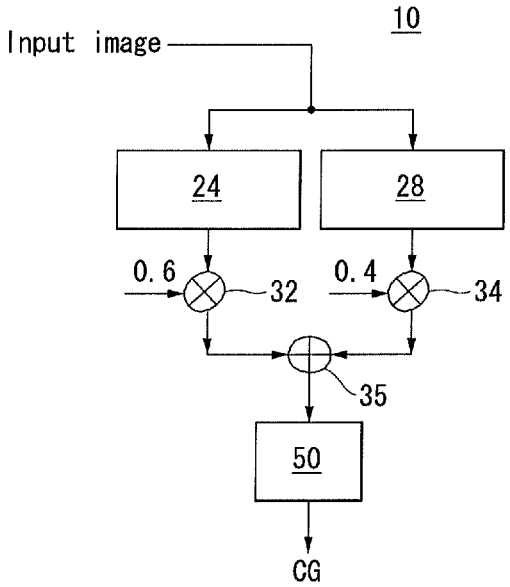

As shown in FIGS. 16A and 16B, the convex gain calculator 10 sets the first and third weighting values C1 and C3 to '0' and may calculate the convex gain CG based on the complexity and the luminance characteristic of the image analyzed by the second and fourth image analyzers 24 and 28. In this instance, a sum of the second and fourth weighting values C2 and C4 is set to 1, and the second and fourth weighting values C2 and C4 may be adjusted by the user. For example, as shown in FIG. 16A, C2 and C4 may be respectively set to 0.6 and 0.4. Other values may be used. Some components 22, 26, 31 and 33 may be removed in a circuit configuration shown in FIG. 16A. Even if the above components 22, 26, 31 and 33 are removed, the circuit shown in FIG. 16A may operate in the same manner as the original circuit including the above components 22, 26, 31 and 33. Hence, the manufacturing cost may be reduced through the simple circuit configuration. In FIGS. 16A and 16B, the second image analyzer 24 calculates the number of recognizable colors based on the histogram of the input image and maps the number of recognizable colors to the mapping curve shown in FIG. 6 to select the second parameter $\alpha 2$. The fourth image analyzer 28 calculates an average value or an average picture level (APL) of peripheral image data of input image data to be displayed on the peripheral blocks and maps the average value or the average picture level of the peripheral image to the mapping curve shown in FIG. 8 to select the fourth parameter $\alpha 4$. The second multiplier 32 multiplies the second parameter α2 by the second weighting value C2 and supplies the multiplication result to the adder 35, and the fourth multiplier 34 multiplies the fourth parameter α4 by the fourth weighting value C4 and supplies the multiplication result to the adder 35. The operation logic unit 50 substitutes the parameter α received from the adder 35 for the above Equation (1) and calculates the convex gain CG using a value obtained by dividing a substitution result by 100.

Figure 17A:
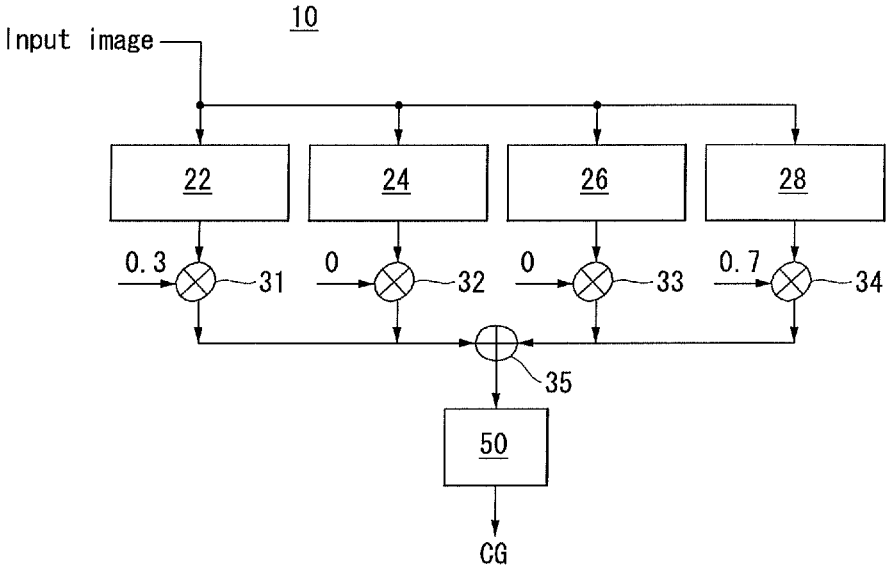
Figure 17B:
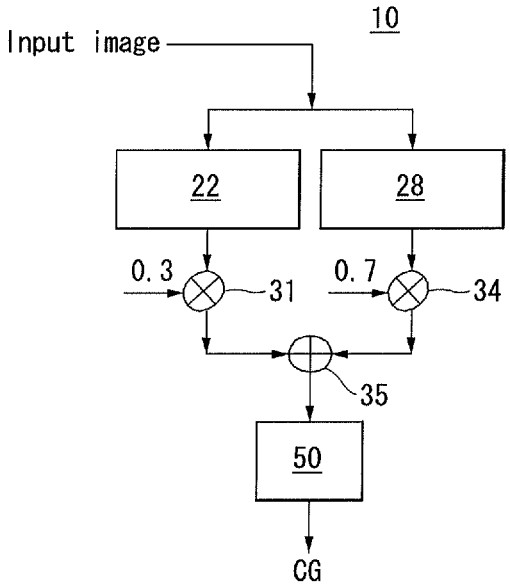

As shown in FIGS. 17A and 17B, the convex gain calculator 10 sets the second and third weighting values C2 and C3 to '0' and may calculate the convex gain CG based on the complexity and the luminance characteristic of the image analyzed by the first and fourth image analyzers 22 and 28. In this instance, a sum of the first and fourth weighting values C1 and C4 is set to 1, and the first and fourth weighting values C1 and C4 may be adjusted by the user. For example, as shown in FIG. 17A, C1 and C4 may be respectively set to 0.3 and 0.7. Other values may be used. Some components 24, 26, 32 and 33 may be removed in a circuit configuration shown in FIG. 17A. Even if the above components 24, 26, 32 and 33 are removed, the circuit shown in FIG. 17A may operate in the same manner as the original circuit including the above components 24, 26, 32 and 33. Hence, the manufacturing cost may be reduced through the simple circuit configuration. In FIGS. 17A and 17B, the first image analyzer 22 detects the edge components from the input image, decides the number of edges the viewer can recognize, and maps the number of edges to the mapping curve shown in FIG. 4 to select the first parameter α1. The fourth image analyzer 28 calculates an average value or an average picture level (APL) of peripheral image data of input image data to be displayed on the peripheral blocks and maps the average value or the average picture level of the peripheral image to the mapping curve shown in FIG. 8 to select the fourth parameter a4. The first multiplier 31 multiplies the first parameter α1 by the first weighting value C1 and supplies the multiplication result to the adder 35, and the fourth multiplier 34 multiplies the fourth parameter α4 by the fourth weighting value C4 and supplies the multiplication result to the adder 35. The operation logic unit 50 substitutes the parameter α received from the adder 35 for the above Equation (1) and calculates the convex gain CG using a value obtained by dividing a substitution result by 100.

Figure 18A:
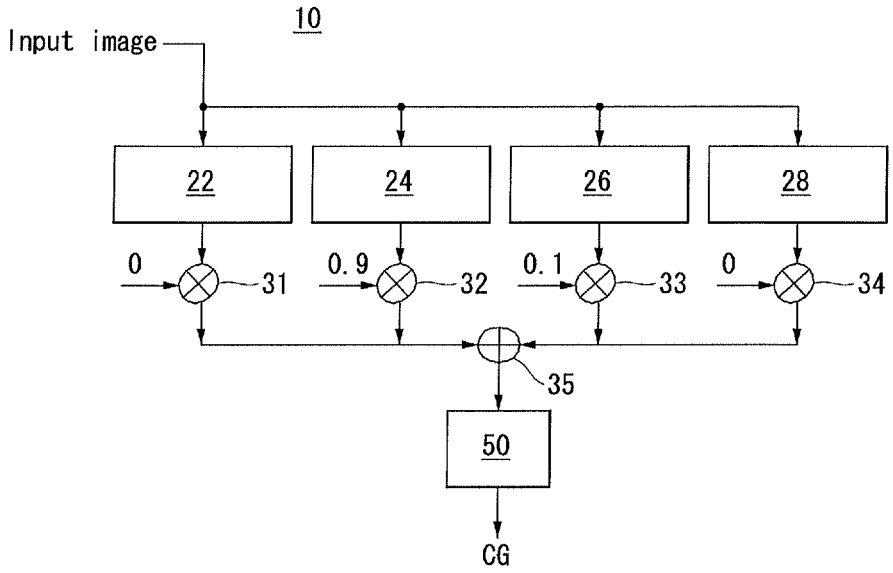
Figure 18B:
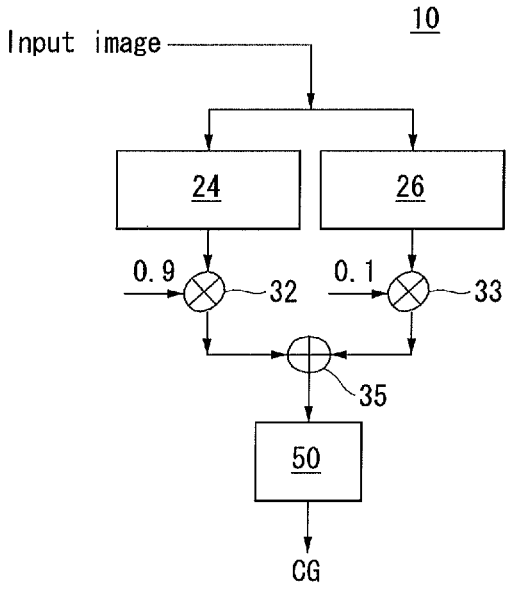

As shown in FIGS. 18A and 18B, the convex gain calculator 10 sets the first and fourth weighting values C1 and C4 to '0' and may calculate the convex gain CG based on the complexity and the luminance characteristic of the image analyzed by the second and third image analyzers 24 and 26. In this instance, a sum of the second and third weighting values C2 and C3 is set to 1, and the second and third weighting values C2 and C3 may be adjusted by the user. For example, as shown in FIG. 18A, C2 and C3 may be respectively set to 0.9 and 0.1. Other values may be used. Some components 22, 28, 31 and 34 may be removed in a circuit configuration shown in FIG. 18A. Even if the above components 22, 28, 31 and 34 are removed, the circuit shown in FIG. 18A may operate in the same manner as the original circuit including the above components 22, 28, 31 and 34. Hence, the manufacturing cost may be reduced through the simple circuit configuration. In FIGS. 18A and 18B, the second image analyzer 24 calculates the number of recognizable colors based on the histogram of the input image and maps the number of recognizable colors to the mapping curve shown in FIG. 6 to select the second parameter α2. The third image analyzer 26 calculates an average value or an average picture level (APL) of image data corresponding to one frame and maps the average value or the average picture level of the entire image of one frame to the mapping curve shown in FIG. 7 to select the third parameter α3. The second multiplier 32 multiplies the second parameter α2 by the second weighting value C2 and supplies the multiplication result to the adder 35, and the third multiplier 33 multiplies the third parameter α3 by the third weighting value C3 and supplies the multiplication result to the adder 35. The operation logic unit 50 substitutes the parameter α received from the adder 35 for the above Equation (1) and calculates the convex gain CG using a value obtained by dividing a substitution result by 100.

Figure 19A:
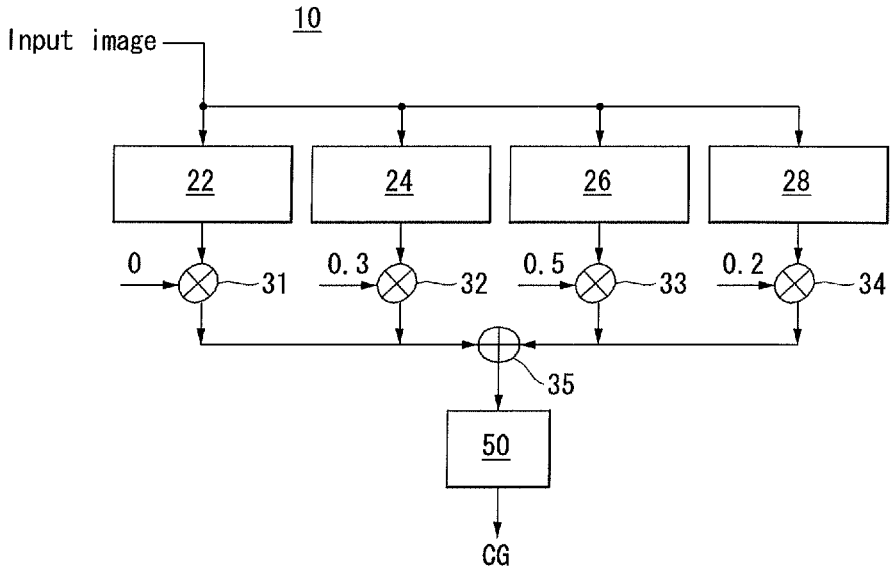
Figure 19B:
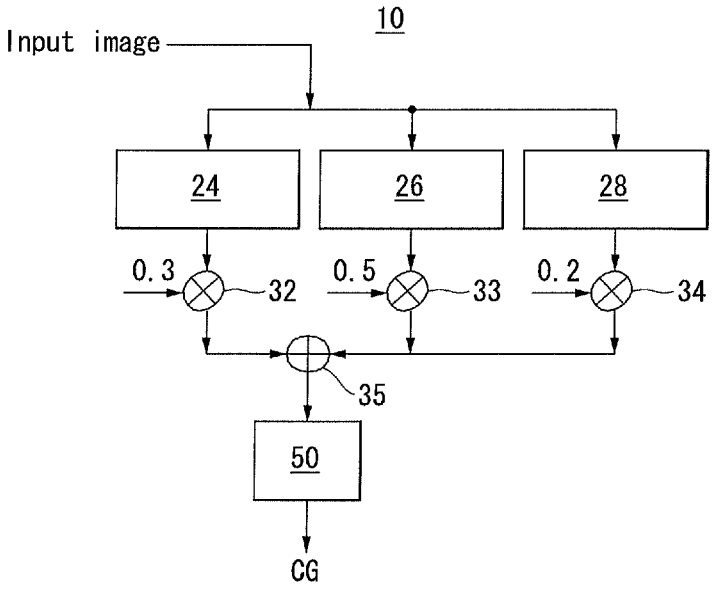

As shown in FIGS. 19A and 19B, the convex gain calculator 10 sets the first weighting value C1 to '0' and may calculate the convex gain CG based on the complexity and the luminance characteristic of the image analyzed by the second, third, and fourth image analyzers 24, 26, and 28. In this instance, a sum of the second, third, and fourth weighting values C2, C3, and C4 is set to 1, and the second, third, and fourth weighting values C2, C3, and C4 may be adjusted by the user. For example, as shown in FIG. 19A, C2, C3, and C4 may be respectively set to 0.3, 0.5, and 0.2. Other values may be used. Some components 22 and 31 may be removed in a circuit configuration shown in FIG. 19A. Even if the above components 22 and 31 are removed, the circuit shown in FIG. 19A may operate in the same manner as the original circuit including the above components 22 and 31. Hence, the manufacturing cost may be reduced through the simple circuit configuration. In FIGS. 19A and 19B, the second image analyzer 24 calculates the number of recognizable colors based on the histogram of the input image and maps the number of recognizable colors to the mapping curve shown in FIG. 6 to select the second parameter α2. The third image analyzer 26 calculates an average value or an average picture level (APL) of image data of one frame and maps the average value or the average picture level of the entire image corresponding to one frame to the mapping curve shown in FIG. 7 to select the third parameter α3. The fourth image analyzer 28 calculates an average value or an average picture level (APL) of peripheral image data of input image data to be displayed on the peripheral blocks and maps the average value or the average picture level of the peripheral image to the mapping curve shown in FIG. 8 to select the fourth parameter α4. The second multiplier 32 multiplies the second parameter α2 by the second weighting value C2 and supplies the multiplication result to the adder 35, and the third multiplier 33 multiplies the third parameter α3 by the third weighting value C3 and supplies the multiplication result to the adder 35. The fourth multiplier 34 multiplies the fourth parameter α4 by the fourth weighting value C4 and supplies the multiplication result to the adder 35. The operation logic unit 50 substitutes the parameter α received from the adder 35 for the above Equation (1) and calculates the convex gain CG using a value obtained by dividing a substitution result by 100.

Figure 20A:
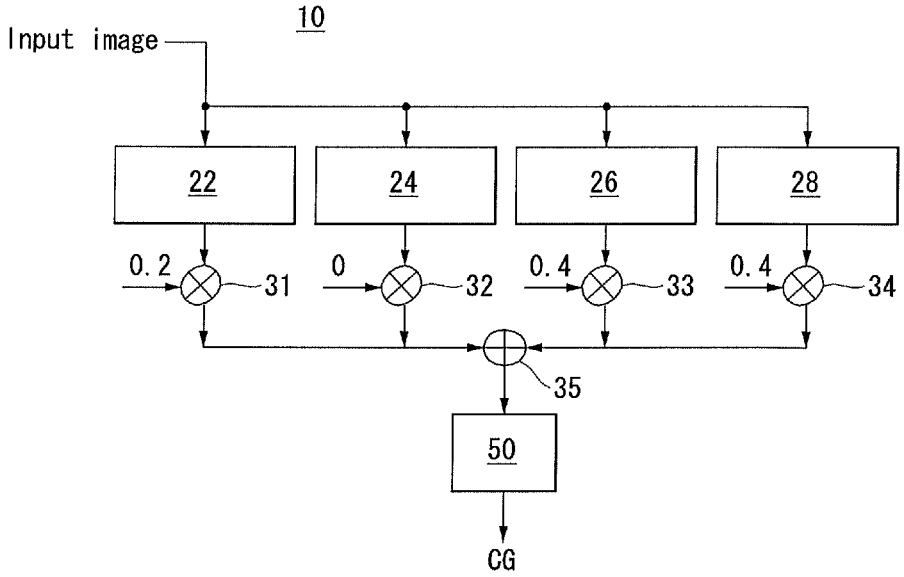
Figure 20B:
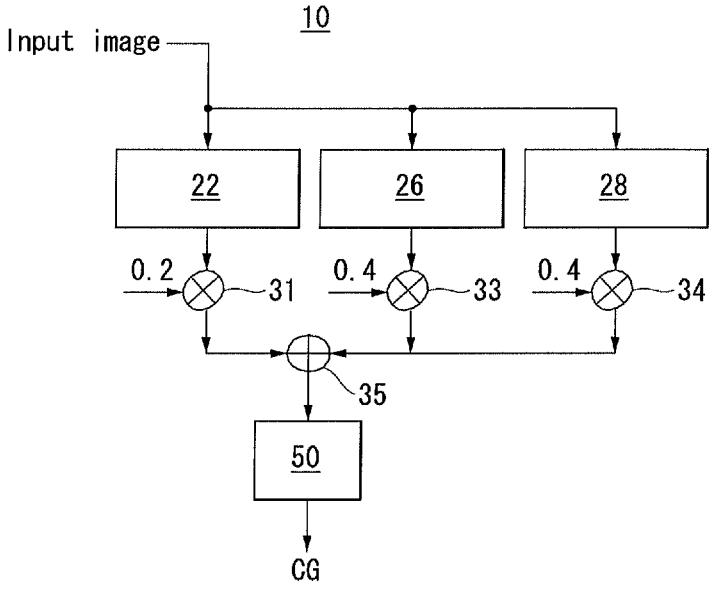

As shown in FIGS. 20A and 20B, the convex gain calculator 10 sets the second weighting value C2 to '0' and may calculate the convex gain CG based on the complexity and the luminance characteristic of the image analyzed by the first, third, and fourth image analyzers 22, 26, and 28. In this instance, a sum of the first, third, and fourth weighting values C1, C3, and C4 is set to 1, and the first, third, and fourth weighting values C1, C3, and C4 may be adjusted by the user. For example, as shown in FIG. 20A, C1, C3, and C4 may be respectively set to 0.2, 0.4, and 0.4. Other values may be used. Some components 24 and 32 may be removed in a circuit configuration shown in FIG. 20A. Even if the above components 24 and 32 are removed, the circuit shown in FIG. 20A may operate in the same manner as the original circuit including the above components 24 and 32. Hence, the manufacturing cost may be reduced through the simple circuit configuration. In FIGS. 20A and 20B, the first image analyzer 22 detects the edge components from the input image, decides the number of edges the viewer can recognize, and maps the number of edges to the mapping curve shown in FIG. 4 to select the first parameter α1. The third image analyzer 26 calculates an average value or an average picture level (APL) of image data of one frame and maps the average value or the average picture level of the entire image of one frame to the mapping curve shown in FIG. 7 to select the third parameter α3. The fourth image analyzer 28 calculates an average value or an average picture level (APL) of peripheral image data of input image data to be displayed on the peripheral blocks and maps the average value or the average picture level of the peripheral image to the mapping curve shown in FIG. 8 to select the fourth parameter α4. The first multiplier 31 multiplies the first parameter α1 by the first weighting value C1 and supplies the multiplication result to the adder 35, and the third multiplier 33 multiplies the third parameter α3 by the third weighting value C3 and supplies the multiplication result to the adder 35. The fourth multiplier 34 multiplies the fourth parameter α4 by the fourth weighting value C4 and supplies the multiplication result to the adder 35. The operation logic unit 50 substitutes the parameter α received from the adder 35 for the above Equation (1) and calculates the convex gain CG using a value obtained by dividing a substitution result by 100.

Figure 21A:
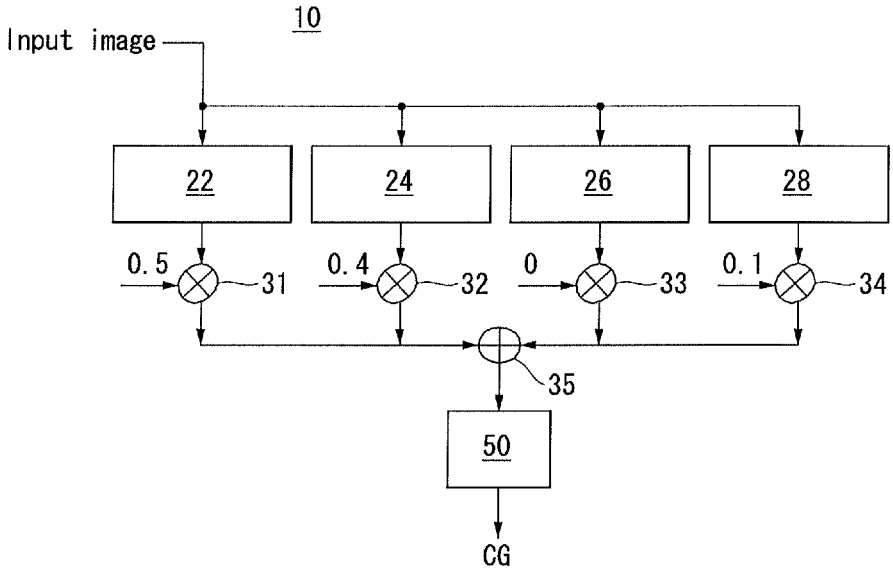
Figure 21B:
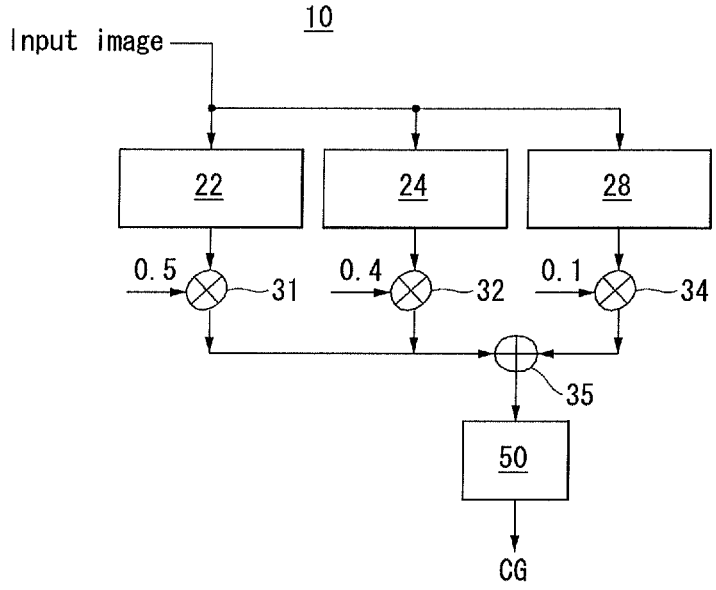

As shown in FIGS. 21A and 21B, the convex gain calculator 10 sets the third weighting value C3 to '0' and may calculate the convex gain CG based on the complexity and the luminance characteristic of the image analyzed by the first, second, and fourth image analyzers 22, 24, and 28. In this instance, a sum of the first, second, and fourth weighting values C1, C2, and C4 is set to 1, and the first, second, and fourth weighting values C1, C2, and C4 may be adjusted by the user. For example, as shown in FIG. 21A, C1, C2, and C4 may be respectively set to 0.5, 0.4, and 0.1. Other values may be used. Some components 26 and 33 may be removed in a circuit configuration shown in FIG. 21A. Even if the above components 26 and 33 are removed, the circuit shown in FIG. 21A may operate in the same manner as the original circuit including the above components 26 and 33. Hence, the manufacturing cost may be reduced through the simple circuit configuration. In FIGS. 21A and 21B, the first image analyzer 22 detects the edge components from the input image, decides the number of edges the viewer can recognize, and maps the number of edges to the mapping curve shown in FIG. 4 to select the first parameter α1. The second image analyzer 24 calculates the number of recognizable colors based on the histogram of the input image and maps the number of recognizable colors to the mapping curve shown in FIG. 6 to select the second parameter α2. The fourth image analyzer 28 calculates an average value or an average picture level (APL) of peripheral image data of input image data to be displayed on the peripheral blocks and maps the average value or the average picture level of the peripheral image to the mapping curve shown in FIG. 8 to select the fourth parameter α4. The first multiplier 31 multiplies the first parameter α1 by the first weighting value C1 and supplies the multiplication result to the adder 35, and the second multiplier 32 multiplies the second parameter α2 by the second weighting value C2 and supplies the multiplication result to the adder 35. The fourth multiplier 34 multiplies the fourth parameter α4 by the fourth weighting value C4 and supplies the multiplication result to the adder 35. The operation logic unit 50 substitutes the parameter α received from the adder 35 for the above Equation (1) and calculates the convex gain CG using a value obtained by dividing a substitution result by 100.

Figure 22A:
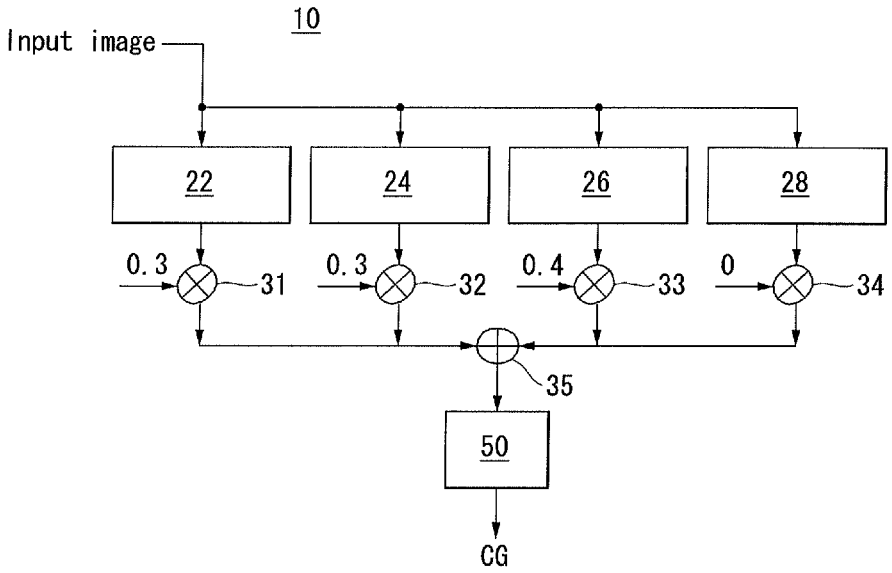
Figure 22B:
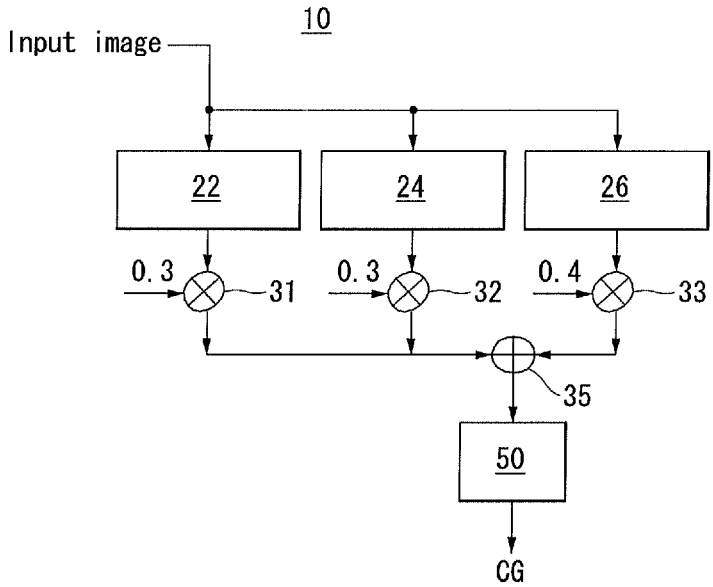

As shown in FIGS. 22A and 22B, the convex gain calculator 10 sets the fourth weighting value C4 to '0' and may calculate the convex gain CG based on the complexity and the luminance characteristic of the image analyzed by the first, second, and third image analyzers 22, 24, and 26. In this instance, a sum of the first, second, and third weighting values C1, C2, and C3 is set to 1, and the first, second, and third weighting values C1, C2, and C3 may be adjusted by the user. For example, as shown in FIG. 22A, C1, C2, and C3 may be respectively set to 0.3, 0.3, and 0.4. Other values may be used. Some components 28 and 34 may be removed in a circuit configuration shown in FIG. 22A. Even if the above components 28 and 34 are removed, the circuit shown in FIG. 22A may operate in the same manner as the original circuit including the above components 28 and 34. Hence, the manufacturing cost may be reduced through the simple circuit configuration. In FIGS. 22A and 22B, the first image analyzer 22 detects the edge components from the input image, decides the number of edges the viewer can recognize, and maps the number of edges to the mapping curve shown in FIG. 4 to select the first parameter α1. The second image analyzer 24 calculates the number of recognizable colors based on the histogram of the input image and maps the number of recognizable colors to the mapping curve shown in FIG. 6 to select the second parameter α2. The third image analyzer 26 calculates an average value or an average picture level (APL) of image data of one frame and maps the average value or the average picture level of the entire image corresponding to one frame to the mapping curve shown in FIG. 7 to select the third parameter α3. The first multiplier 31 multiplies the first parameter α1 by the first weighting value C1 and supplies the multiplication result to the adder 35, and the second multiplier 32 multiplies the second parameter α2 by the second weighting value C2 and supplies the multiplication result to the adder 35. The third multiplier 33 multiplies the third parameter α3 by the third weighting value C3 and supplies the multiplication result to the adder 35. The operation logic unit 50 substitutes the parameter α received from the adder 35 for the above Equation (1) and calculates the convex gain CG using a value obtained by dividing a substitution result by 100.

Figure 23:
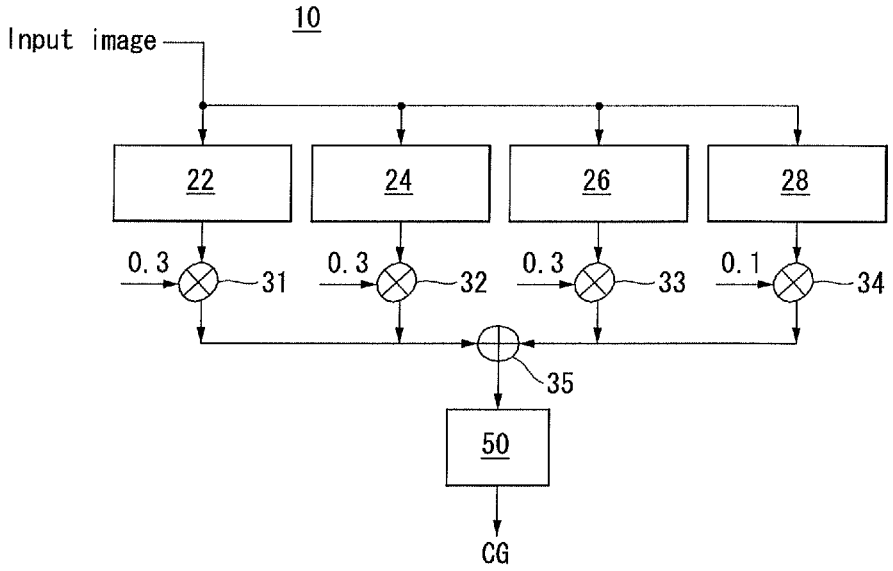
Figure 24A:
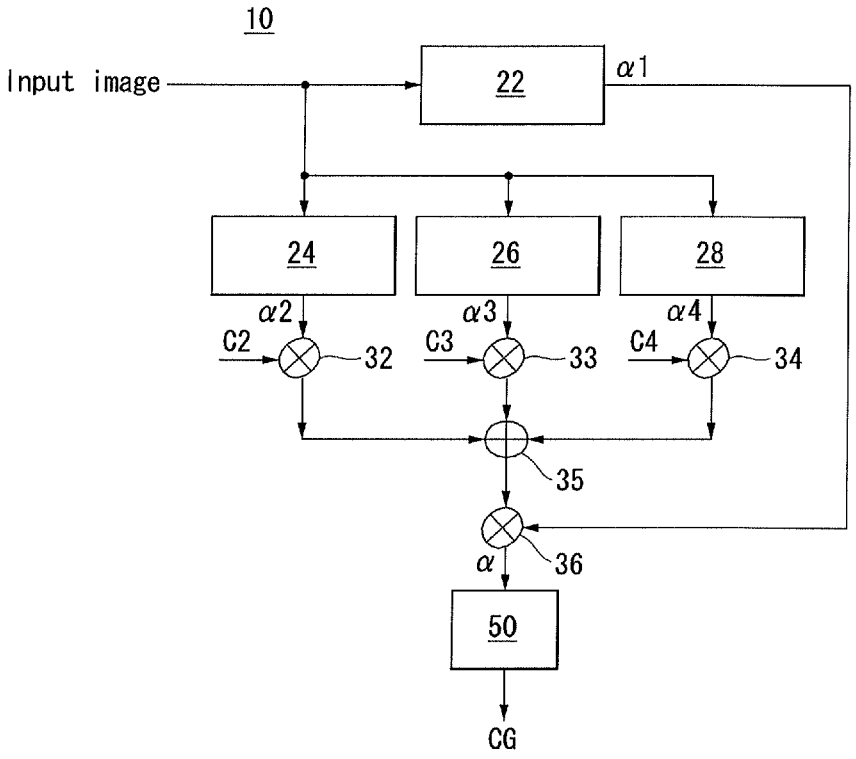
FIGS. 24A to 24D are block diagrams of a convex gain calculator according to a second embodiment of the invention.
Figure 24B:
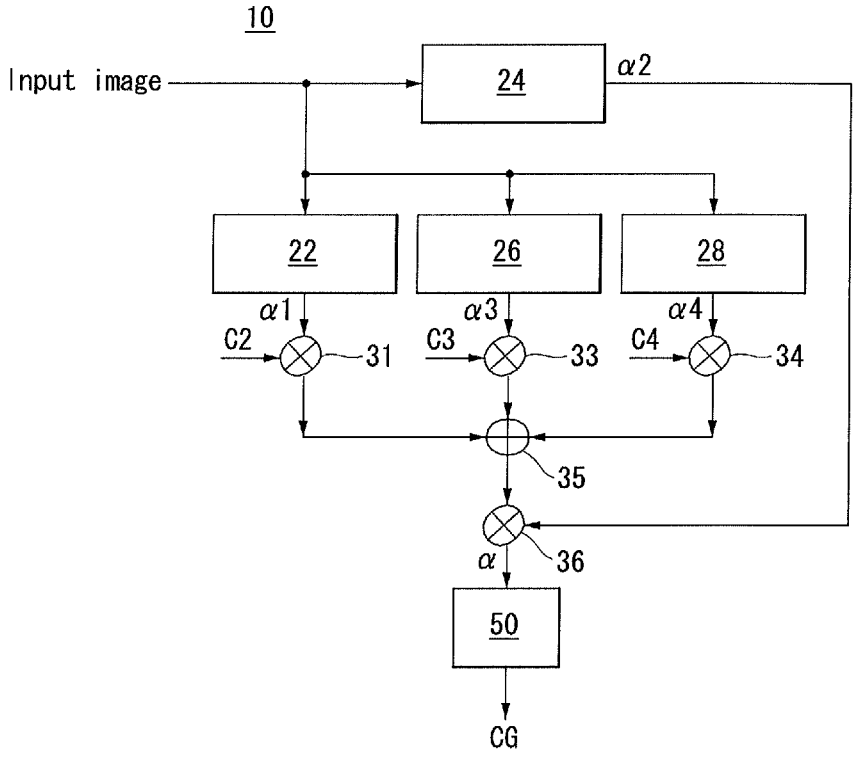
Figure 24C:
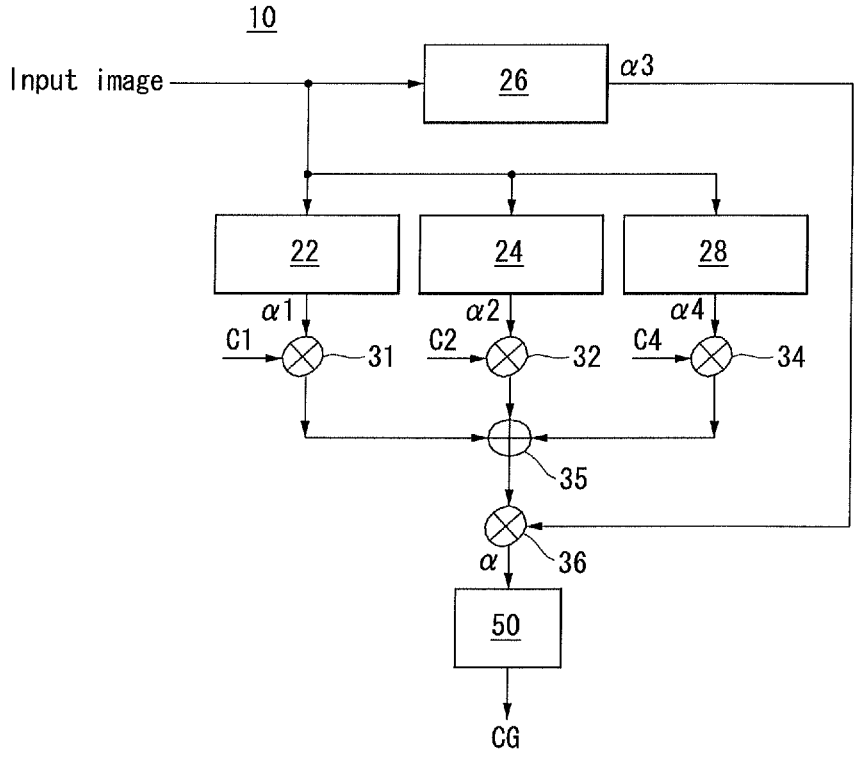
Figure 24D:
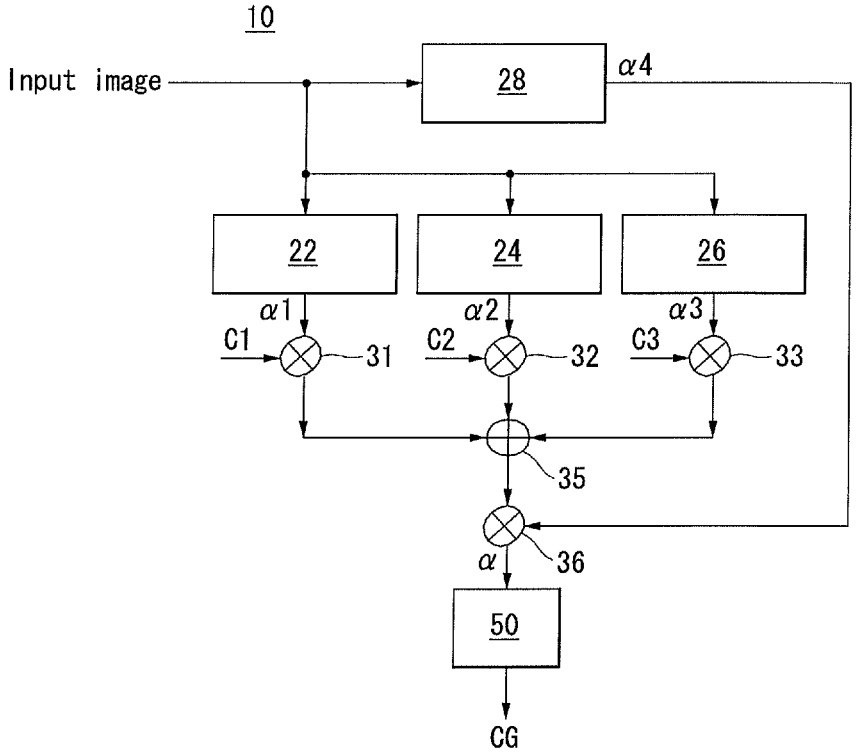

As shown in FIG. 23, the convex gain calculator 10 may calculate the convex gain CG based on the complexity and the luminance characteristic of the image analyzed by the first to fourth image analyzers 22, 24, 26, and 28. In this instance, a sum of the first to fourth weighting values C1 to C4 is set to 1, and the first to fourth weighting values C1 to C4 may be adjusted by the user. For example, as shown in FIG. 23, C1, C2, C3, and C4 may be respectively set to 0.3, 0.3, 0.3, and 0.1. Other values may be used. The first image analyzer 22 detects the edge components from the input image, decides the number of edges the viewer can recognize, and maps the number of edges to the mapping curve shown in FIG. 4 to select the first parameter α1. The second image analyzer 24 calculates the number of recognizable colors based on the histogram of the input image and maps the number of recognizable colors to the mapping curve shown in FIG. 6 to select the second parameter α2. The third image analyzer 26 calculates an average value or an average picture level (APL) of image data of one frame and maps the average value or the average picture level of the entire image of one frame to the mapping curve shown in FIG. 7 to select the third parameter α3. The fourth image analyzer 28 calculates an average value or an average picture level (APL) of peripheral image data of input image data to be displayed on the peripheral blocks and maps the average value or the average picture level of the peripheral image to the mapping curve shown in FIG. 8 to select the fourth parameter α4. The first multiplier 31 multiplies the first parameter α1 by the first weighting value C1 and supplies the multiplication result to the adder 35, and the second multiplier 32 multiplies the second parameter α2 by the second weighting value C2 and supplies the multiplication result to the adder 35. The third multiplier 33 multiplies the third parameter α3 by the third weighting value C3 and supplies the multiplication result to the adder 35, and the fourth multiplier 34 multiplies the fourth parameter α4 by the fourth weighting value C4 and supplies the multiplication result to the adder 35. The operation logic unit 50 substitutes the parameter α received from the adder 35 for the above Equation (1) and calculates the convex gain CG using a value obtained by dividing a substitution result by 100.

In the above-described modifications, the parameters α1 to α4 and the weighting values C1 to C4, which are selected based on the complexity and the luminance characteristic of the image so as to adjust the backlight dimming value, were calculated through a parallel operation, and then the result of the parallel operation was input to the adder 35. However, the convex gain calculator according to the embodiment of the invention is not limited to a parallel operation circuit. For example, as shown in FIGS. 24A to 24D, the convex gain calculator according to the embodiment of the invention may be implemented as a serial-parallel operation circuit or a serial operation circuit.

FIGS. 24A to 24D are block diagrams of a convex gain calculator according to a second embodiment of the invention.

As shown in FIGS. 24A to 24D, a convex gain calculator 10 according to the second embodiment of the invention includes first to fourth image analyzers 22, 24, 26, and 28, multipliers 31 to 34 and 36, an adder 35, an operation logic unit 50, etc.

In the same manner as the convex gain calculator shown in FIG. 3, at least two of the first to fourth image analyzers 22, 24, 26, and 28 select parameters based on the result of an analysis of an input image, and the selected parameters are calculated through a parallel operation, are multiplied by different weighting values, and are add to one another using an adder 35. The remaining image analyzer(s) except the at least two image analyzers performing the parallel operation selects a parameter based on the result of the analysis of the input image, and the selected parameter is multiplied by an output of the adder 35 using the multiplier 36 and is input to the operation logic unit 50. The operation logic unit 50 substitutes a parameter 'α' received from the multiplier 36 for the above Equation (1) and calculates a convex gain CG using a value obtained by dividing a substitution result by 100.

Figure 25:
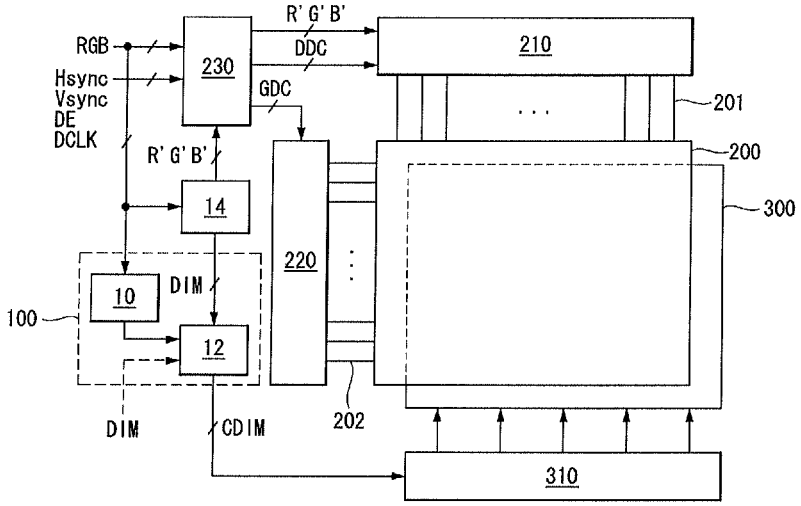
FIG. 25 is a block diagram of a liquid crystal display according to an example embodiment of the invention.

FIG. 25 illustrates a liquid crystal display according to an example embodiment of the invention. The liquid crystal display according to the embodiment of the invention may be implemented in any known liquid crystal mode including a vertical electric field driving manner such as a twisted nematic (TN) mode and a vertical alignment (VA) mode and a horizontal electric field driving manner such as an in-plane switching (IPS) mode and a fringe field switching (FFS) mode.

As shown in FIG. 25, the liquid crystal display according to the embodiment of the invention includes a liquid crystal display panel 200, a source driver 210 for driving data lines 201 of the liquid crystal display panel 200, a gate driver 220 for driving gate lines 202 of the liquid crystal display panel 200, a timing controller 230 for controlling operation timing of each of the source driver 210 and the gate driver 220, a backlight unit 300 for irradiating light onto the liquid crystal display panel 200, a light source driver 310 for driving a plurality of light sources of the backlight unit 300, and the backlight dimming control device 100 for controlling backlight dimming.

The liquid crystal display panel 200 includes a liquid crystal layer between two glass substrates. The liquid crystal display panel 200 includes a pixel array which is arranged in a matrix form defined by a crossings structure of the data lines 201 and the gate lines 202 and to which video data of an input image is written. The data lines 201, the gate lines 203, thin film transistors (TFTs), pixel electrodes of liquid crystal cells connected to the TFTs, storage capacitors, etc. are formed on a TFT array substrate of the liquid crystal display panel 200. Black matrixes, color filters, common electrodes, etc. are formed on a color filter substrate of the liquid crystal display panel 200.

The pixel array constituting the screen of the liquid crystal display panel 200 and a light emitting surface of the backlight unit 300 opposite the pixel array may be virtually divided into N×M blocks as shown in FIG. 2. Each of pixels constituting the pixel array may include red, green, and blue subpixels so as to represent the colors. Each of the red, green, and blue subpixels includes a liquid crystal cell.

The timing controller 230 receives timing signals Vsync, Hsync, DE, and DCLK from an external host system and supplies digital video data RGB of the input image to the source driver 210. The timing signals Vsync, Hsync, DE, and DCLK includes a vertical sync signal Vsync, a horizontal sync signal Hsync, a data enable DE, and a dot clock CLK. The timing controller 230 generates timing signals DDC and GDC for respectively controlling the operation timing of the source driver 210 and the operation timing of the gate driver 220 based on the timing signals Vsync, Hsync, DE, and DCLK received from the host system. The timing controller 230 supplies the digital video data RGB of the input image received from the host system to a local dimming circuit 14 and may supply digital video data R'G'B' modulated by the local dimming circuit 14 to the source driver 210.

The host system includes a main board such as a television set, a navigator, and a personal digital assistant. The main board transfers the digital video data RGB of the input image and the timing signals Vsync, Hsync, DE, and DCLK to the timing controller 230 through a scaler of a graphic controller. The host system performs the existing global/local dimming algorism and thus may produce a backlight dimming signal. A backlight dimming value DIM thus produced may be input to the backlight dimming control device 100 indicated by the dotted lines of FIG. 25.

The source driver 210 latches the modulated digital video data R'G'B' under the control of the timing controller 230. The source driver 210 converts the modulated digital video data R'G'B' into positive and negative analog data voltages using positive and negative gamma compensation voltages and supplies the positive and negative analog data voltages to the data lines 201. The gate driver 220 sequentially supplies a gate pulse (or scan pulse) synchronized with the data voltage on the data lines 201 to the gate lines 202.

The backlight unit 300 is positioned under the liquid crystal display panel 200. The backlight unit 300 includes the plurality of light sources, which are individually controlled on a per block basis by the light source driver 310, and uniformly irradiates light onto the liquid crystal display panel 200. The backlight unit 300 may be implemented as a direct type backlight unit or an edge type backlight unit. The plurality of light sources of the backlight unit 300 may be a point light source such as a light emitting diode (LED).

The light source driver 310 individually drives the light sources of the backlight unit 300 on a per block basis using a PWM duty ratio defined by a compensated backlight dimming value CDIM output from the backlight dimming control device 100, thereby controlling a luminance of each block.

The local dimming circuit 14 produces the backlight dimming value DIM for controlling a backlight luminance of each block depending on the input image based on the local dimming algorism. The local dimming algorism may use any known local dimming algorism.

The backlight dimming control device 100 may be implemented by the above-described embodiments illustrated in FIGS. 1 to 24D. Thus, the backlight dimming control device 100 includes a convex gain calculator 10 for producing a convex gain CG and a backlight dimming adjuster 12 for adjusting the backlight dimming value DIM using the convex gain CG. The backlight dimming control device 100 adjusts the backlight dimming value received from the host system or the local dimming circuit 14 using the convex gain CG and controls the light source driver 310 based on the adjustment of the backlight dimming value. The backlight dimming value to be applied to the peripheral part of the screen is reduced due to the convex gain CG. The convex gain CG is adaptively adjusted based on the result of an analysis of the input image and thus may differently control an adjustment degree of the backlight dimming value DIM within range, in which the viewer cannot perceive changes in a luminance with the naked eye.

As described above, the embodiment of the invention adjusts the backlight dimming value produced by the existing global/local dimming algorism using the convex gain, which decreases as it goes to the peripheral part of the screen. Hence, the embodiment of the invention may greatly reduce power consumption of the liquid crystal display without a reduction in the image quality, which the viewer can perceive, as compared to the existing global/local dimming algorism.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A backlight dimming method comprising:

producing a first backlight dimming value controlling a backlight luminance of a liquid crystal display panel, wherein a screen of the liquid crystal display panel is virtually divided into a plurality of blocks, having a peripheral part of the screen comprises the plurality of blocks disposed along a peripheral of the screen, and a central part of the screen comprises the plurality of blocks disposed in a central part of the screen away from the peripheral part;

producing a convex gain which has less value in the peripheral part of a screen of the liquid crystal display panel than the central part of the screen;

reducing the first backlight dimming value to be applied to the peripheral part of the screen using the convex gain to produce a second backlight dimming value;

controlling the backlight luminance of the liquid crystal display panel using the second backlight dimming value;

analyzing a complexity of an input image; and adjusting the convex gain based on the result of an analysis of the input image, wherein the analyzing the complexity of the input image includes:

calculating a histogram in each of colors of the input image data corresponding to one frame and adding a number of recognizable colors based on the calculated histogram, deciding gray levels, at which the number of pixels is equal to or greater than a predetermined threshold value, based on the histogram and calculating a sum of the gray levels to detect a number of recognizable colors from the input image to be displayed on the peripheral part of the screen;

producing a first parameter, which is proportional to the number of colors from input image to be displayed on the peripheral part of the screen, wherein the convex gain is reduced in proportion to the first parameter.

2. The backlight dimming method of claim 1, comprising multiplying the convex gain by the first backlight dimming value.

3. The backlight dimming method of claim 1, wherein the analyzing the complexity of the input image further includes:

calculating an average luminance of the input image corresponding to one frame to be displayed on the central part and the peripheral part of the screen;

calculating an average luminance of a peripheral image of the input image to be displayed on the peripheral part of the screen;

producing a second parameter proportional to the average luminance of the input image corresponding to one frame, and a third parameter proportional to the average luminance of the peripheral image;

multiplying the first parameter by a first weighting value, multiplying the second parameter by a second weighting value, and multiplying the third parameter by a third weighting value; and adding the first parameter by which the first weighting value is multiplied, the second parameter by which the second weighting value is multiplied, and the third parameter by which the third weighting value is multiplied, to produce a final parameter, wherein the convex gain is reduced in proportion to the final parameter, wherein the first weighting value is greater than each of the second weighting value and the third weighting value.

4. A liquid crystal display comprising:

a dimming value generator configured to produce a first backlight dimming value controlling a backlight luminance of a liquid crystal display panel, wherein a screen of the liquid crystal display panel is virtually divided into a plurality of blocks, having a peripheral part of the screen comprises the plurality of blocks disposed along a peripheral of the screen, and a central part of the screen comprises the plurality of blocks disposed in a central part of the screen away from the peripheral part;

a convex gain calculator configured to produce a convex gain which has less value in the peripheral part of a screen of the liquid crystal display panel than the central part of the screen; and a backlight dimming adjuster configured to reduce a first backlight dimming value to be applied to the peripheral part of the screen using the convex gain, produce a second backlight dimming value, and control the backlight luminance of the liquid crystal display panel using the second backlight dimming value, wherein the convex gain calculator analyzes a complexity of an input image and adjusts the convex gain based on the result of an analysis of the input image, wherein the convex gain calculator calculates a histogram in each of colors of the input image data corresponding to one frame, adds a number of recognizable colors based on the calculated histogram, decides gray levels, at which the number of pixels is equal to or greater than a predetermined threshold value, based on the histogram, and calculates a sum of the gray levels to detect a number of recognizable colors from the input image to be displayed on the peripheral part of the screen to produce a first parameter, which is proportional to the number of colors from input image to be displayed on the peripheral part of the screen, wherein the convex gain is reduced in proportion to the first parameter.

5. The liquid crystal display of claim 4, wherein the convex gain is multiplied by the first backlight dimming value.

6. The liquid crystal display of claim 4, wherein the convex gain calculator further calculates an average luminance of the input image corresponding to one frame to be displayed on the central part and the peripheral part of the screen, calculates an average luminance of a peripheral image of the input image to be displayed on the peripheral part of the screen, produce a second parameter proportional to the average luminance of the input image corresponding to one frame and a third parameter proportional to the average luminance of the peripheral image; multiplies the first parameter by a first weighting value, multiplies the second parameter by a second weighting value, multiplies the third parameter by a third weighting value, and adds the first parameter by which the first weighting value is multiplied, the second parameter by which the second weighting value is multiplied, and the third parameter by which the third weighting value is multiplied, to produce a final parameter, wherein the convex gain is reduced in proportion to the final parameter, wherein the first weighting value is greater than each of the second weighting value and the third weighting value.

* * * * *